US009857827B2

(12) United States Patent
Burghdoff

(10) Patent No.: US 9,857,827 B2
(45) Date of Patent: Jan. 2, 2018

(54) LOCKING SYSTEM FOR AN ACTUATOR DEVICE

(71) Applicant: The Boeing Company, Chicago, IL (US)

(72) Inventor: Michael Jay Burghdoff, Everett, WA (US)

(73) Assignee: THE BOEING COMPANY, Chicago, IL (US)

( * ) Notice: Subject to any disclaimer, the term of this patent is extended or adjusted under 35 U.S.C. 154(b) by 583 days.

(21) Appl. No.: 14/196,462

(22) Filed: Mar. 4, 2014

(65) Prior Publication Data

US 2015/0253805 A1 Sep. 10, 2015

(51) Int. Cl.
*G05G 5/18* (2006.01)

(52) U.S. Cl.
CPC ..... *G05G 5/18* (2013.01); *Y10T 74/20648* (2015.01)

(58) Field of Classification Search
CPC ..... F02K 1/763; F02K 1/766; F16B 15/26; F16B 15/261; B64C 25/26; B64C 25/18; B64C 25/20; B64C 25/22; G05G 5/005; G05G 5/02; G05G 5/04; G05G 5/28; E05B 51/02; E05B 81/28; F16D 2011/006; F16D 23/06
See application file for complete search history.

(56) References Cited

U.S. PATENT DOCUMENTS 2,811,136 A * 10/1957 Westcott, Jr. ..... B64C 25/22 244/102 SL
5,979,255 A * 11/1999 Huang ..... B60S 1/08 15/250.16
2012/0172174 A1 7/2012 Kopecek

* cited by examiner

*Primary Examiner* — Richard W Ridley
*Assistant Examiner* — Brian McGovern
(74) *Attorney, Agent, or Firm* — Yee & Associates, P.C.

(57) ABSTRACT

A method and apparatus for operating a locking system for an actuator device. The apparatus comprises a lock collar and a locking device. The lock collar shares a center axis with a piston having a first number of features that extend from the piston away from a center axis of the piston. The lock collar has a second number of features that extend towards the center axis. The locking device is configured to rotate the lock collar between a lock position in which the second number of features of the lock collar is engaged with the first number of features of the piston and an unlock position in which the second number of features of the lock collar is disengaged from the first number of features of the piston.

14 Claims, 20 Drawing Sheets

2000

2002
SPECIFICATION AND DESIGN
2004
MATERIAL PROCUREMENT
2006
COMPONENT AND SUBASSEMBLY MANUFACTURING
2008
SYSTEM INTEGRATION
2010
CERTIFICATION AND DELIVERY
2012
IN SERVICE
2014
MAINTENANCE AND SERVICE

2100

AIRCRAFT
2102
AIRFRAME
INTERIOR
2106
SYSTEMS
PROPULSION SYSTEM
ELECTRICAL SYSTEM
2108
2112
2110
2114
2104
HYDRAULIC SYSTEM
ENVIRONMENTAL SYSTEM

LOCKING SYSTEM FOR AN ACTUATOR DEVICE

BACKGROUND INFORMATION

1. Field

The present disclosure relates generally to an actuator device and, in particular, to a locking system for an actuator device. Still more particularly, the present disclosure relates to a method and apparatus for moving an actuator device between a locked state and an unlocked state using a lock collar and a locking device.

2. Background

An actuator is a device used to move or control a mechanism or system. Actuators are used in different types of systems. These systems may include, but are not limited to, aircraft, spacecraft, ground vehicles, water vehicles, engine systems, building support systems, computer systems, valve systems, manufacturing equipment, and other types of systems. Depending on the implementation, an actuator may provide linear motion, rotary motion, another type of motion, or some combination thereof.

An actuator that provides linear motion may be referred to as a linear actuator. Examples of linear actuators include hydraulic actuators and pneumatic actuators. Hydraulic actuators create linear motion using pressurized hydraulic fluid. Pneumatic actuators create linear motion using compressed air.

Oftentimes, a linear actuator is used to create reciprocating linear motion. Reciprocating linear motion is movement back and forth along a straight line. With some linear actuators, a force is applied to a piston to move the piston in a desired direction along a straight line. The force applied to the piston may be generated using pressurized hydraulic fluid or compressed air. The piston is typically a cylindrical shaped object, such as a rod. Movement of the piston in the desired direction transfers the force developed by the piston to an external object to be moved. When the force being applied to the piston is removed, the piston moves back in the direction opposite the desired direction.

Locking a linear actuator to prevent the piston in a linear actuator from being able to move may be desirable in some cases. A locking device may be used to lock the linear actuator. The linear actuator and locking device may be together referred to as an actuator system. In some cases, the actuator system may also include a housing for holding the linear actuator and the locking device.

Some currently available locking devices use a sleeve that is configured to move linearly along the center axis of the piston. When the sleeve is in a lock position relative to the linear actuator, the piston is prevented from moving in the desired direction. Moving the sleeve in a selected direction along the center axis of the piston away from the lock position unlocks the piston and allows the piston to move in the desired direction.

This type of locking device may increase the size and weight of the actuator system more than desired. For example, the size of the actuator housing needed to accommodate the sleeve and movement of the sleeve relative to the piston of the linear actuator may be larger than desired. Therefore, it would be desirable to have a method and apparatus that take into account at least some of the issues discussed above, as well as other possible issues.

SUMMARY

In one illustrative embodiment, an apparatus comprises a lock collar and a locking device. The lock collar shares a center axis with a piston having a first number of features that extend from the piston away from a center axis of the piston. The lock collar has a second number of features that extend towards the center axis. The locking device is configured to rotate the lock collar between a lock position in which the second number of features of the lock collar is engaged with the first number of features of the piston and an unlock position in which the second number of features of the lock collar is disengaged from the first number of features of the piston.

In another illustrative embodiment, an actuator system comprises a piston, a lock collar, a locking device, a following biasing element, and a following collar. The piston has a first number of teeth that extend from the piston away from a center axis of the piston. The lock collar is positioned relative to the piston such that the lock collar and the piston share the center axis. The lock collar has a second number of teeth that extend from the lock collar towards the center axis. The locking device is configured to rotate the lock collar between a lock position in which the second number of teeth of the lock collar is engaged with the first number of teeth of the piston and an unlock position in which the second number of teeth of the lock collar is disengaged from the first number of teeth of the piston. The piston is allowed to translate along the center axis when the lock collar is in the unlock position and prevented from translating along the center axis when the lock collar is in the lock position. The following collar is positioned relative to the lock collar such that the following collar shares the center axis with the lock collar and the piston. The following collar has a third number of teeth that extend from the following collar away from the center axis. The following biasing element causes the following collar to follow the piston when the piston translates such that the third number of teeth of the following collar interlocks with the second number of teeth of the lock collar to prevent the lock collar from rotating about the center axis from the unlock position to the lock position.

In yet another illustrative embodiment, a method for operating a locking system for an actuator device is provided. A lock collar is rotated about a center axis shared by the lock collar and a piston from a lock position to an unlock position using a locking device to disengage a first number of features extending from the piston away from the center axis from a second number of features extending from the lock collar towards the center axis to allow the piston to translate along the center axis. The lock collar is rotated about the center axis from the unlock position to the lock position using the locking device to engage the first number of features of the piston from the second number of features of the lock collar to prevent the piston from translating along the center axis.

The features and functions can be achieved independently in various embodiments of the present disclosure or may be combined in yet other embodiments in which further details can be seen with reference to the following description and drawings.

BRIEF DESCRIPTION OF THE DRAWINGS

The novel features believed characteristic of the illustrative embodiments are set forth in the appended claims. The illustrative embodiments, however, as well as a preferred mode of use, further objectives and features thereof, will best be understood by reference to the following detailed description of an illustrative embodiment of the present disclosure when read in conjunction with the accompanying drawings, wherein:

DETAILED DESCRIPTION

The illustrative embodiments recognize and take into account different considerations. For example, the illustrative embodiments recognize and take into account that it may be desirable to have a method and apparatus for locking a linear actuator that does not increase the size or weight of the overall actuator system more than desired. Further, the illustrative embodiments recognize and take into account that using a locking system based on rotary motion about the center axis through the piston in the linear actuator may not result in using a housing for the linear actuator that is larger than desired.

Thus, the illustrative embodiments provide a method and apparatus for locking and unlocking a piston in an actuator device. In one illustrative example, a locking system includes a lock collar and a locking device. The lock collar is positioned relative to a piston such that the lock collar shares a center axis with the piston. The lock collar allows the piston to translate along the center axis when the lock collar is in an unlock position and prevents the piston from translating along the center axis when the lock collar is in a lock position. The locking device is configured to rotate the lock collar between the lock position and the unlock position.

Figure 1:
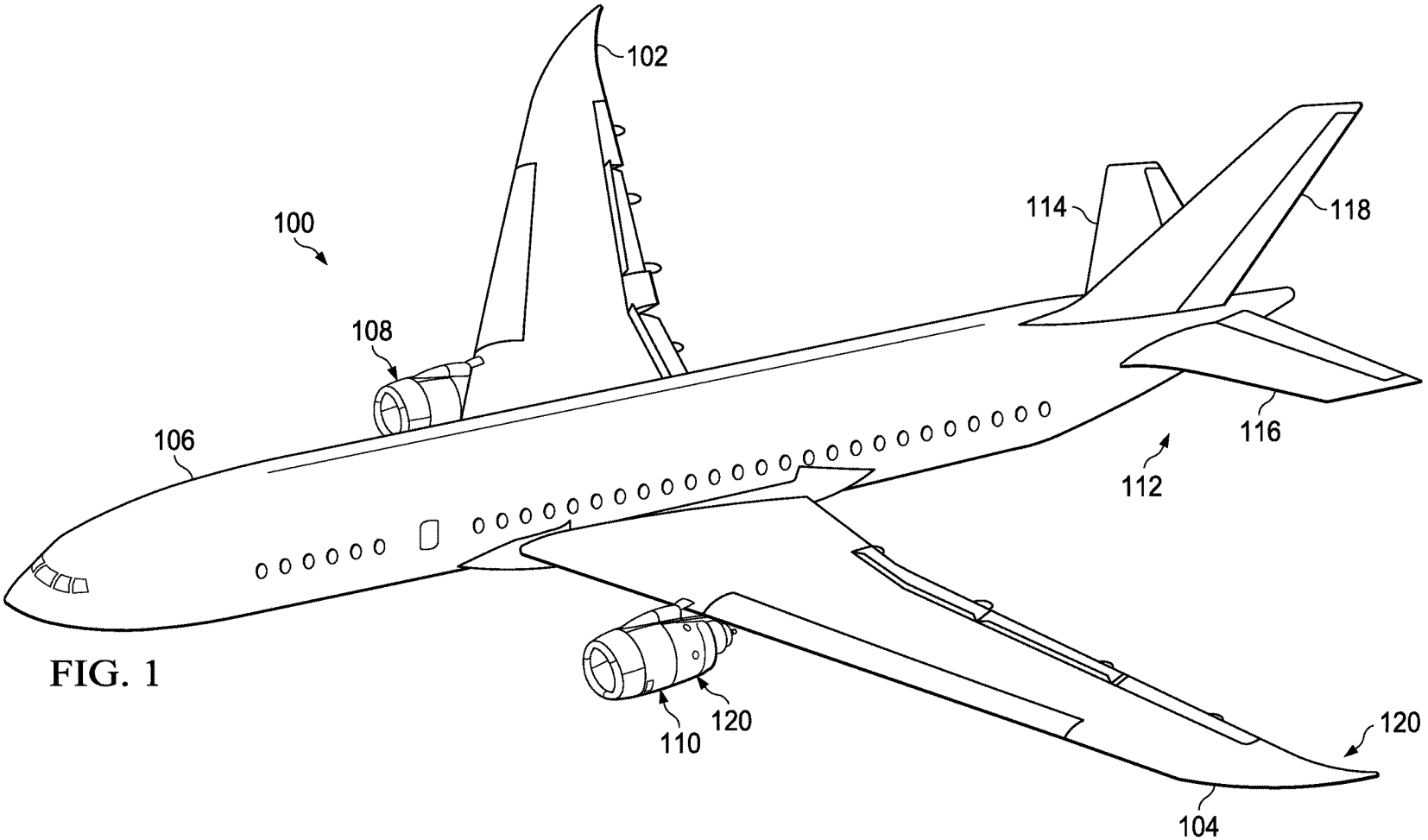
FIG. 1 is an illustration of an isometric view of an aircraft in accordance with an illustrative embodiment.

Referring now to the figures and, in particular, with reference to FIG. 1, an illustration of an isometric view of an aircraft is depicted in accordance with an illustrative embodiment. In this illustrative example, aircraft 100 has wing 102 and wing 104 attached to body 106. Aircraft 100 includes engine 108 attached to wing 102 and engine 110 attached to wing 104.

Body 106 has tail section 112. Horizontal stabilizer 114, horizontal stabilizer 116, and vertical stabilizer 118 are attached to tail section 112 of body 106.

Aircraft 100 is an example of an aircraft in which an actuator system having a locking system may be implemented in accordance with an illustrative embodiment. For example, as depicted, engine 110 has thrust reverser 120. An actuator system implemented in a manner similar to actuator system 300 in FIG. 3 below may be used to translate thrust reverser 120.

Figure 2:
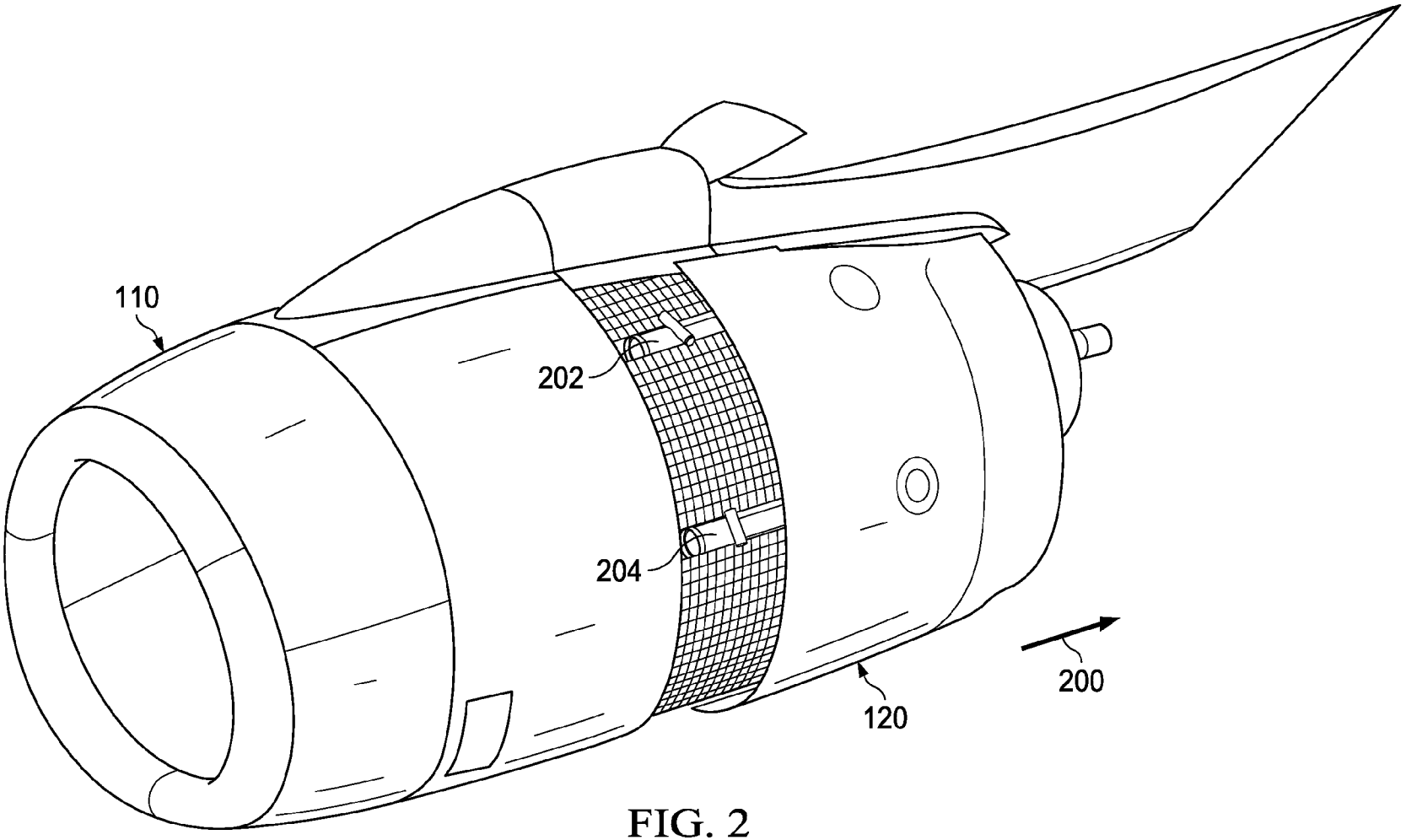
FIG. 2 is an illustration of an enlarged view of an engine in accordance with an illustrative embodiment.

With reference now to FIG. 2, an illustration of an enlarged view of engine 110 from FIG. 1 is depicted in accordance with an illustrative embodiment. In particular, an enlarged view of thrust reverser 120 of engine 110 in a deployed state is seen in FIG. 2.

In this illustrative example, thrust reverser 120 of engine 110 has been moved in the direction of arrow 200 into the deployed state. As depicted, thrust reverser 120 of engine 110 has been moved in the direction of arrow 200. In other words, thrust reverser 120 has translated in the direction of arrow 200. A plurality of actuator systems, including actuator system 202 and actuator system 204 may be used to move thrust reverser 120 in the direction of arrow 200. Each of these actuator systems may have a locking system that uses a lock collar and a locking device to move an actuator device in the actuator system between a locked state and an unlocked state. Actuator system 202 and actuator system 204 are examples of implementations for actuator system 300 described in FIG. 3 below.

Figure 3:
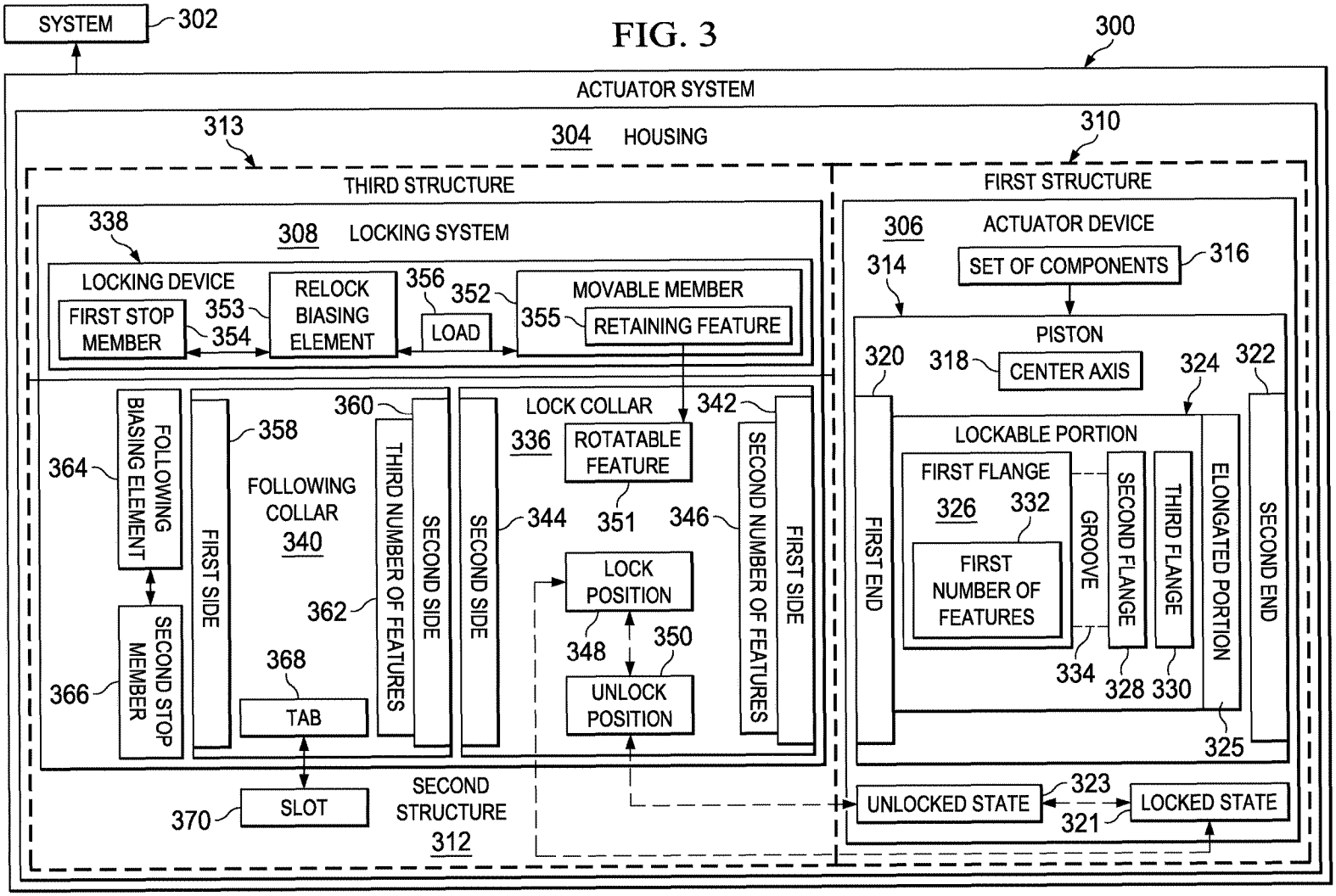
FIG. 3 is an illustration of an actuator system in the form of a block diagram of in accordance with an illustrative embodiment.

With reference now to FIG. 3, an illustration of an actuator system is depicted in the form of a block diagram in accordance with an illustrative embodiment. In this illustrative example, actuator system 300 may be used in system 302. System 302 may take a number of different forms. System 302 may take the form of, for example, without limitation, an aircraft, an automobile, a spacecraft, a ship, a computer, a valve system, an engine, a machining device, or some other type of system.

As depicted, actuator system 300 includes housing 304, actuator device 306, and locking system 308. Actuator device 306 and locking system 308 may be associated with housing 304.

As used herein, when one component is "associated" with another component, the association is a physical association in the depicted examples. For example, a first component, such as actuator device 306 may be considered to be associated with a second component, such as housing 304, by being at least one of secured to the second component, bonded to the second component, mounted to the second component, welded to the second component, fastened to the second component, or connected to the second component in some other suitable manner. In some cases, the first component may be configured to be held within or retained by the second component. The first component also may be connected to the second component using a third component. Further, the first component may be considered to be associated with the second component by being formed as part of the second component, an extension of the second component, or both.

In this illustrative example, actuator device 306 and locking system 308 are located within housing 304. As depicted, housing 304 includes first structure 310, second structure 312, and third structure 313. In one illustrative example, first structure 310, second structure 312, and third structure 313 may be associated with each other. Depending on the implementation, at least one of first structure 310, second structure 312, and third structure 313 may be unitary with at least another one of first structure 310, second structure 312, and third structure 313. As used herein, a first component that is "unitary with" a second component means that the two components form a single unit. For example, the second component may be part of the first component.

Further, as used herein, the phrase "at least one of," when used with a list of items, means different combinations of one or more of the listed items may be used and only one of the items in the list may be needed. The item may be a particular object, thing, or category. In other words, "at least one of" means any combination of items or number of items may be used from the list, but not all of the items in the list may be required.

For example, "at least one of item A, item B, and item C" may mean item A; item A and item B; item B; item A, item B, and item C; or item B and item C. In some cases, "at least one of item A, item B, and item C" may mean, for example, without limitation, two of item A, one of item B, and ten of item C; four of item B and seven of item C; or some other suitable combination.

In this illustrative example, actuator device 306 may include piston 314 and set of components 316. Piston 314 is an object configured to be moved linearly in a direction along center axis 318 of piston 314. Linear movement of piston 314 along center axis 318 may be referred to as translation along center axis 318. Center axis 318 is an axis that lies along the line formed by geometric centers of first end 320 and second end 322 of piston 314. In this illustrative example, center axis 318 may be an axis of symmetry for piston 314. Piston 314 may only be allowed to translate along center axis 318. Piston 314 may have zero rotational degrees of freedom with respect to center axis 318.

Piston 314 may take the form of a substantially cylindrical structure having lockable portion 324 and elongated portion 325. For example, piston 314 may take the form of a cylindrical rod having elongated portion 325 and lockable portion 324. Of course, depending on the implementation, any number of features may be associated with piston 314 such that the overall shape of piston 314 differs from a substantially cylindrical shape.

In this illustrative example, lockable portion 324 and elongated portion 325 may be separate portions of piston 314. However, in other illustrative examples, elongated portion 325 may extend from first end 320 to second end 322 of piston 314 and lockable portion 324 may be formed by a portion of elongated portion 325 located at first end 320 of piston 314.

In this illustrative example, lockable portion 324 moves actuator device 306 between locked state 321 and unlocked state 323. As depicted, lockable portion 324 has first flange 326, second flange 328, and third flange 330 that extend from the cylindrical structure that forms piston 314.

First flange 326 is located the closest to first end 320 of piston 314. Third flange 330 is located the furthest away from first end 320. Second flange 328 is located between first flange 326 and third flange 330. As depicted, groove 334 is formed between first flange 326 and second flange 328.

In this illustrative example, first flange 326 may be comprised of first number of features 332. As used herein, a "number of" items may include one or more items. In this manner, first number of features 332 may include one or more items.

First number of features 332 extends away from center axis 318 of piston 314. In this illustrative example, first number of features 332 may entirely form first flange 326. In this manner, first flange 326 may be a discontinuous extension from the cylindrical structure that forms piston 314. However, in other illustrative examples, first number of features 332 may form only a portion of first flange 326.

In one illustrative example, first number of features 332 may take the form of a first number of teeth. When first number of features 332 takes the form of a first number of teeth, first flange 326 may be referred to as a toothed flange.

In the illustrative example, locking system 308 is used to engage and disengage first number of features 332 to move actuator device 306 between locked state 321 and unlocked state 323, respectively. As depicted, locking system 308 includes lock collar 336, locking device 338, and following collar 340.

Lock collar 336 is positioned relative to piston 314 such that lock collar 336 shares center axis 318 with piston 314. Lock collar 336 has first side 342 and second side 344. Second number of features 346 is associated with lock collar 336. Second number of features 346 is located at or near first side 342 of lock collar 336.

Second number of features 346 is configured to extend from lock collar 336 towards center axis 318. Second number of features 346 is used to engage first number of features 332 of lockable portion 324 of piston 314.

In this illustrative example, second number of features 346 may be engaged with first number of features 332 by sitting within groove 334 in a position at least partially aligned with first number of features 332. Second number of features 346 may be at least partially aligned with first number of features 332 when at least a portion of second number of features 346 overlaps with at least a portion of first number of features 332 such that any relative movement between first number of features 332 and second number of features 346 outside of selected tolerances is prevented. When second number of features 346 is engaged with first number of features 332, first number of features 332 is also considered engaged with second number of features 346.

Second number of features 346 may be disengaged from first number of features 332 when second number of features 346 is completely unaligned with first number of features 332. Second number of features 346 may be completely unaligned with first number of features 332 when second number of features 346 does not overlap with any portion of first number of features 332 such that relative movement between first number of features 332 and second number of features 346 may be allowed. When second number of features 346 is disengaged from first number of features 332, first number of features 332 is also considered disengaged from second number of features 346.

When second number of features 346 of lock collar 336 engages first number of features 332 of piston 314, lock collar 336 is in lock position 348. When lock collar 336 is in lock position 348, actuator device 306 is in locked state 321 such that piston 314 is unable to translate along center axis 318 outside of selected tolerances. In particular, lock collar 336 bears the load of piston 314 to keep actuator device 306 in locked state 321.

Conversely, when second number of features 346 of lock collar 336 is disengaged from first number of features 332 of piston 314, lock collar 336 is in unlock position 350. When lock collar 336 is in unlock position 350, actuator device 306 is in unlocked state 323 such that piston 314 is allowed to translate along center axis 318.

In this illustrative example, rotatable feature 351 may be fixedly associated with lock collar 336. By being fixedly associated with lock collar 336, any movement of rotatable feature 351 results in a corresponding movement of lock collar 336. Rotatable feature 351 takes the form of a tab or some other type of protruding member located on an outer surface of lock collar 336. Rotatable feature 351 extends away from the outer surface of lock collar 336 in a direction away from center axis 318.

Locking device 338 may be configured to rotate rotatable feature 351 about center axis 318 between a first position and a second position to move lock collar 336 between lock position 348 and unlock position 350, respectively. In particular, when rotatable feature 351 is in the first position, lock collar 336 may be in lock position 348 where second number of features 346 is at least partially aligned with first number of features 332. Rotation of rotatable feature 351 about center axis 318 from the first position to the second position may cause lock collar 336 to rotate from lock position 348 to unlock position 350 where second number of features 346 is completely unaligned with first number of features 332.

Locking device 338 may include movable member 352, relock biasing element 353, and first stop member 354. Movable member 352 may take the form of a piston in some illustrative examples. In these examples, movable member 352 may be referred to as a lock piston. Movable member 352 may have retaining feature 355. Retaining feature 355 may be configured to receive and constrain rotatable feature 351 associated with lock collar 336. Retaining feature 355 may limit the range of rotation for rotatable feature 351 such that rotatable feature 351 is only capable of rotating between the first position and the second position.

A force may be applied to movable member 352 to move movable member 352 in a first direction substantially perpendicular to center axis 318. Moving movable member 352 in the first direction causes rotatable feature 351 to rotate from the first position to the second position to move lock collar 336 from lock position 348 to unlock position 350. Retaining feature 355 prevents rotatable feature 351 from being rotated past the first position.

Movement of movable member 352 in the first direction applies load 356 to relock biasing element 353. Relock biasing element 353 may take the form of a compression spring in one illustrative example. Applying load 356 to relock biasing element 353 causes relock biasing element 353 to shorten. In other words, relock biasing element 353 may compress. First stop member 354 may be configured to provide a rest for relock biasing element 353 such that relock biasing element 353 may be compressed against first stop member 354.

When the force being applied to movable member 352 is removed, load 356 applied to relock biasing element 353 is reduced. This reduction causes relock biasing element 353 to expand and move movable member 352 in a second direction substantially perpendicular to center axis 318. Movement of movable member 352 in the second direction causes rotatable feature 351 to rotate from the second position to the first position to move lock collar 336 from unlock position 350 to lock position 348. In this manner, relock biasing element 353 moves movable member 352 in the second direction to rotate lock collar 336 about center axis 318 from unlock position 350 to lock position 348 in response to load 356 no longer being applied to relock biasing element 353. Thus, actuator device 306 is relocked. Retaining feature 355 prevents rotatable feature 351 from being rotated past the second position.

When lock collar 336 is in unlock position 350, piston 314 may be translated along center axis 318 in a desired direction away from lock collar 336. This desired direction may be towards second end 322 of piston 314. Piston 314 may be moved by, for example, set of components 316 in actuator device 306. Set of components 316 may include one or more components configured to apply a force to piston 314 to cause piston 314 to translate in the desired direction.

As piston 314 is translated in the desired direction, following collar 340 may follow piston 314. Following biasing element 364 may be positioned relative to lock collar 336 such that following collar 340 shares center axis 318 with lock collar 336 and piston 314. Following biasing element 364 may take the form of a compression spring in one illustrative example.

Following collar 340 has first side 358 and second side 360. Following biasing element 364 is positioned at first side 358 of following collar 340. Lock collar 336 is located at second side 360 of following collar 340. Second stop member 366 is positioned relative to following biasing element 364. Second stop member 366 may be configured to provide a rest for following biasing element 364 such that following biasing element 364 may be compressed against second stop member 366.

Third number of features 362 is associated with following collar 340 at or near second side 360 of following collar 340. Third number of features 362 may take the form of a third number of teeth in some illustrative examples.

Following biasing element 364 may cause following collar 340 to follow piston 314 as piston 314 translates in the desired direction along center axis 318. When following collar 340 moves in the desired direction along center axis 318, third number of features 362 interlocks with second number of features 346 associated with lock collar 336 to prevent lock collar 336 from rotating about center axis 318 from unlock position 350 to lock position 348. In particular, third number of features 362 interlocks with lock collar 336 by sitting within the gaps between second number of features 346.

Following collar 340 may have tab 368 in this illustrative example. Tab 368 may be received by slot 370 in second structure 312 of housing 304. Tab 368 and slot 370 may be used to prevent following collar 340 from rotating about center axis 318. In particular, tab 368 and slot 370 ensure that following collar 340 has zero degrees of rotational freedom with respect to center axis 318.

The illustration of actuator system 300 in FIG. 3 is not meant to imply physical or architectural limitations to the manner in which an illustrative embodiment may be implemented. Other components in addition to or in place of the ones illustrated may be used. Some components may be optional. Also, the blocks are presented to illustrate some functional components. One or more of these blocks may be combined, divided, or combined and divided into different blocks when implemented in an illustrative embodiment.

In other illustrative examples, first number of features 332 may be associated with lockable portion 324 of piston 314 in some other manner other than by forming first flange 326. In some cases, following collar 340 may not have tab 368. Instead, some other means may be used to prevent following collar 340 from rotating about center axis 138.

Figure 4:
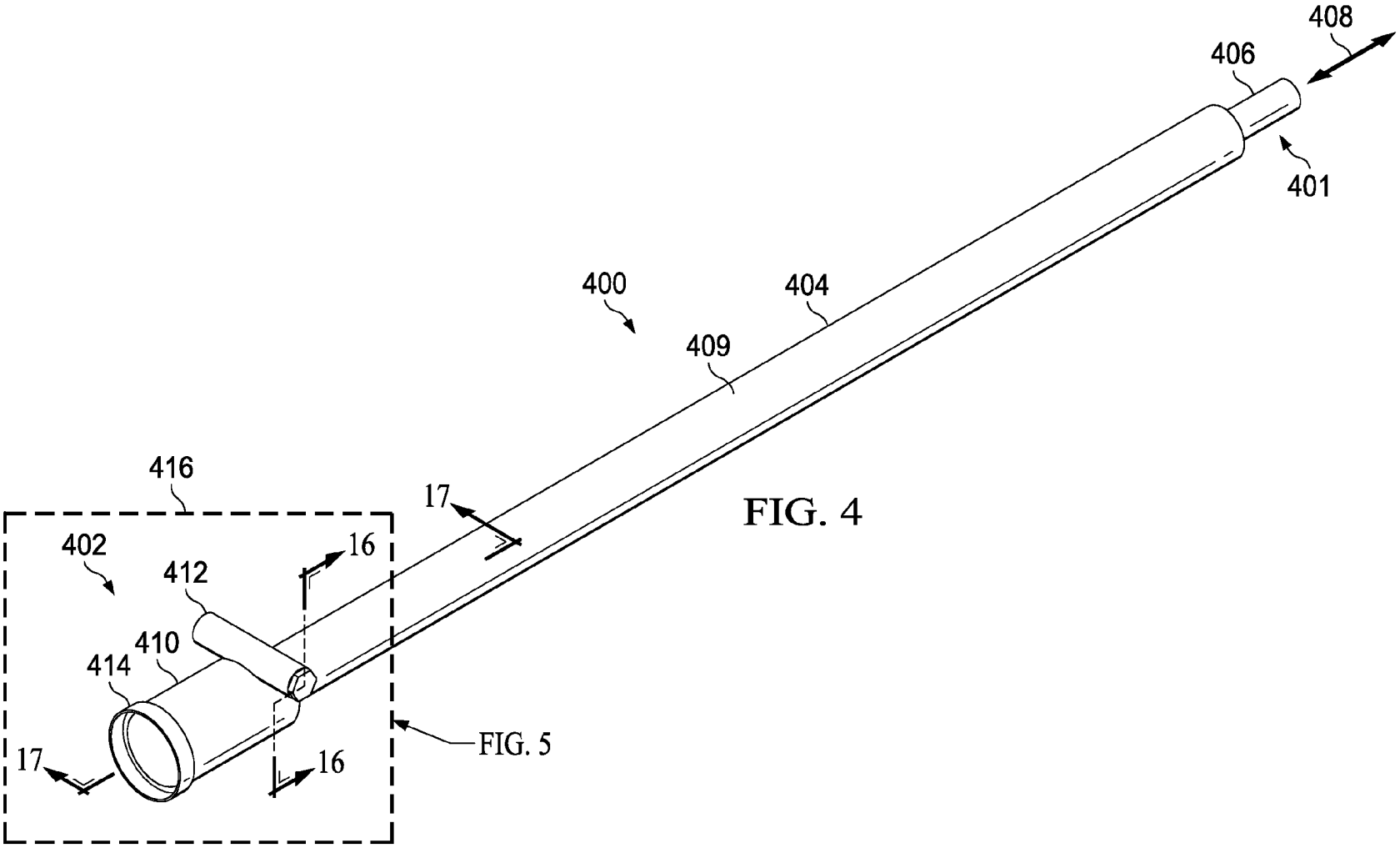
FIG. 4 is an illustration of an isometric view of an actuator system in accordance with an illustrative embodiment.

With reference now to FIG. 4, an illustration of an isometric view of an actuator system is depicted in accordance with an illustrative embodiment. In this illustrative example, actuator system 400 is an example of one implementation for actuator system 300 in FIG. 4. Further, actuator system 400 may be an example of one manner in which actuator system 202 and actuator system 204 in FIG. 2 may be implemented.

As depicted, actuator system 400 includes actuator device 401, locking system 402, and housing 404. Actuator device 401, locking system 402, and housing 404 are examples of implementations for actuator device 306, locking system 308, and housing 304, respectively, in FIG. 3.

In this illustrative example, actuator device 401 includes piston 406. Piston 406 may be configured to translate along center axis 408. Center axis 408 is an example of one implementation for center axis 318 in FIG. 3. Locking system 402 is used to move actuator device 401 between a locked state and an unlocked state, such as locked state 321 and unlocked state 323, respectively, in FIG. 3.

Housing 404 includes first structure 409, second structure 410, and third structure 412. First structure 409, second structure 410, and third structure 412 may be examples of implementations for first structure 310, second structure 312, and third structure 313, respectively, in FIG. 3.

First structure 409 houses at least a portion of actuator device 401. Second structure 410 is used to house a portion of locking system 402. As depicted, second structure 410 may have cap 414, which may be removed from second structure 410 to allow access within second structure 410. Third structure 412 is used to house another portion of locking system 402. A portion of actuator device 401 is located within second structure 410 in this illustrative example.

Portion 416 of actuator system 400 may be the portion that includes locking system 402. Portion 416 is described in greater detail in the figures below.

Figure 5:
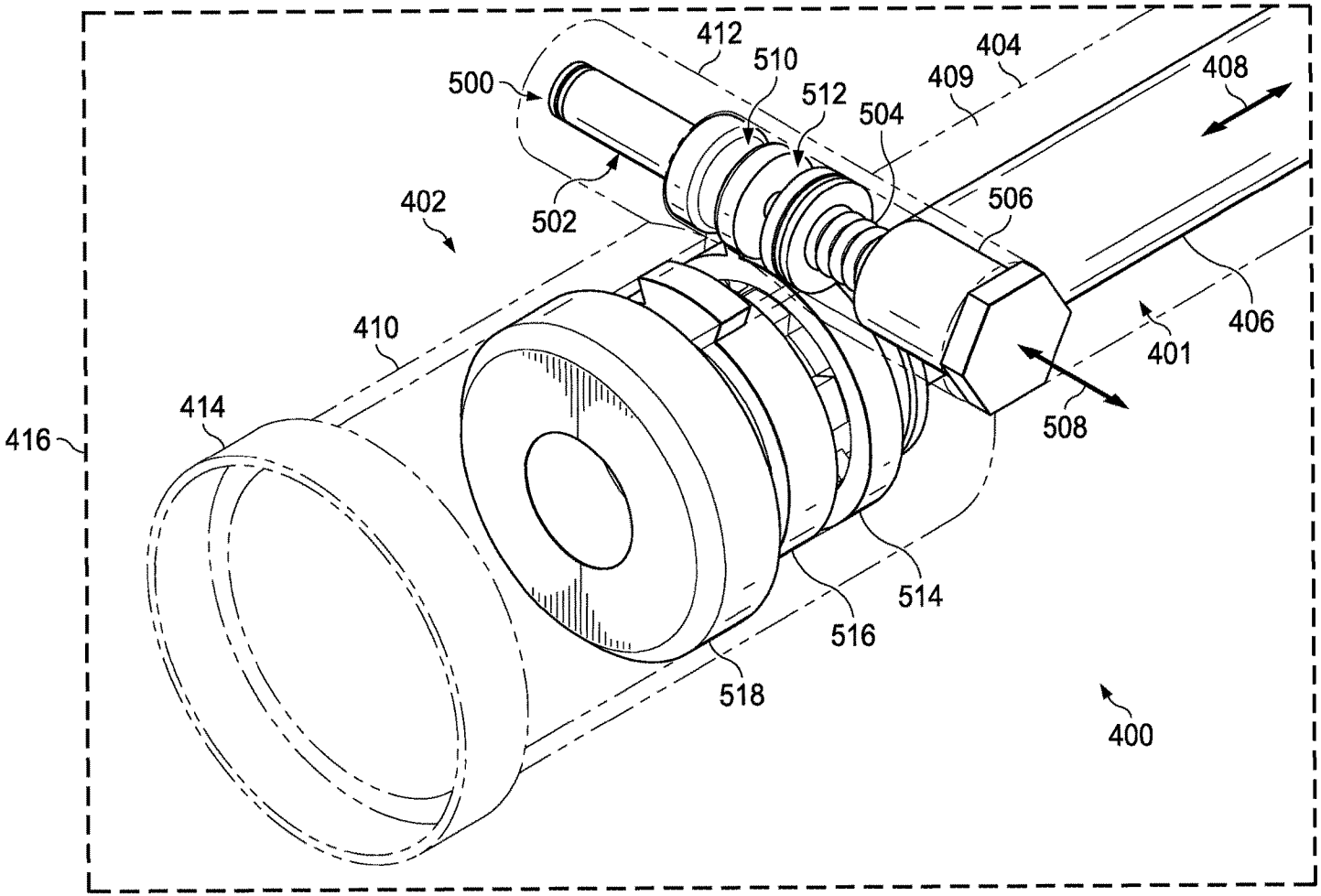
FIG. 5 is an illustration of an enlarged isometric view of a portion of an actuator system from with a housing shown in phantom in accordance with an illustrative embodiment.

With reference now to FIG. 5, an illustration of an enlarged isometric view of portion 416 of actuator system 400 from FIG. 4 with housing 404 shown in phantom is depicted in accordance with an illustrative embodiment. As depicted, locking system 402 includes locking device 500. Locking device 500 may be an example of one implementation for locking device 338 in FIG. 3.

In this illustrative example, locking device 500 includes movable member 502, relock spring 504, and stop member 506. Movable member 502, relock spring 504, and stop member 506 are examples of implementations for movable member 352, relock biasing element 353, and first stop member 354, respectively, in FIG. 3.

Movable member 502 is configured to translate along center axis 508 through movable member 502. Relock spring 504 is a compression spring in this illustrative example. Translation of movable member 502 in a direction towards relock spring 504 along center axis 508 causes relock spring 504 to compress against stop member 506.

Movable member 502 has retaining feature 510 and retaining feature 512. Retaining feature 510 and retaining feature 512 are grooves in this illustrative example. Retaining feature 510 may be an example of one implementation for retaining feature 355 in FIG. 3.

In this illustrative example, locking system 402 also includes lock collar 514, following collar 516, a spring (not shown in this view), and stop member 518. Lock collar 514, following collar 516, and stop member 518 may be examples of implementations for lock collar 336, following collar 340, and second stop member 366, respectively, in FIG. 3. As depicted, lock collar 514 and following collar 516 share center axis 408 with piston 406.

Figure 6:
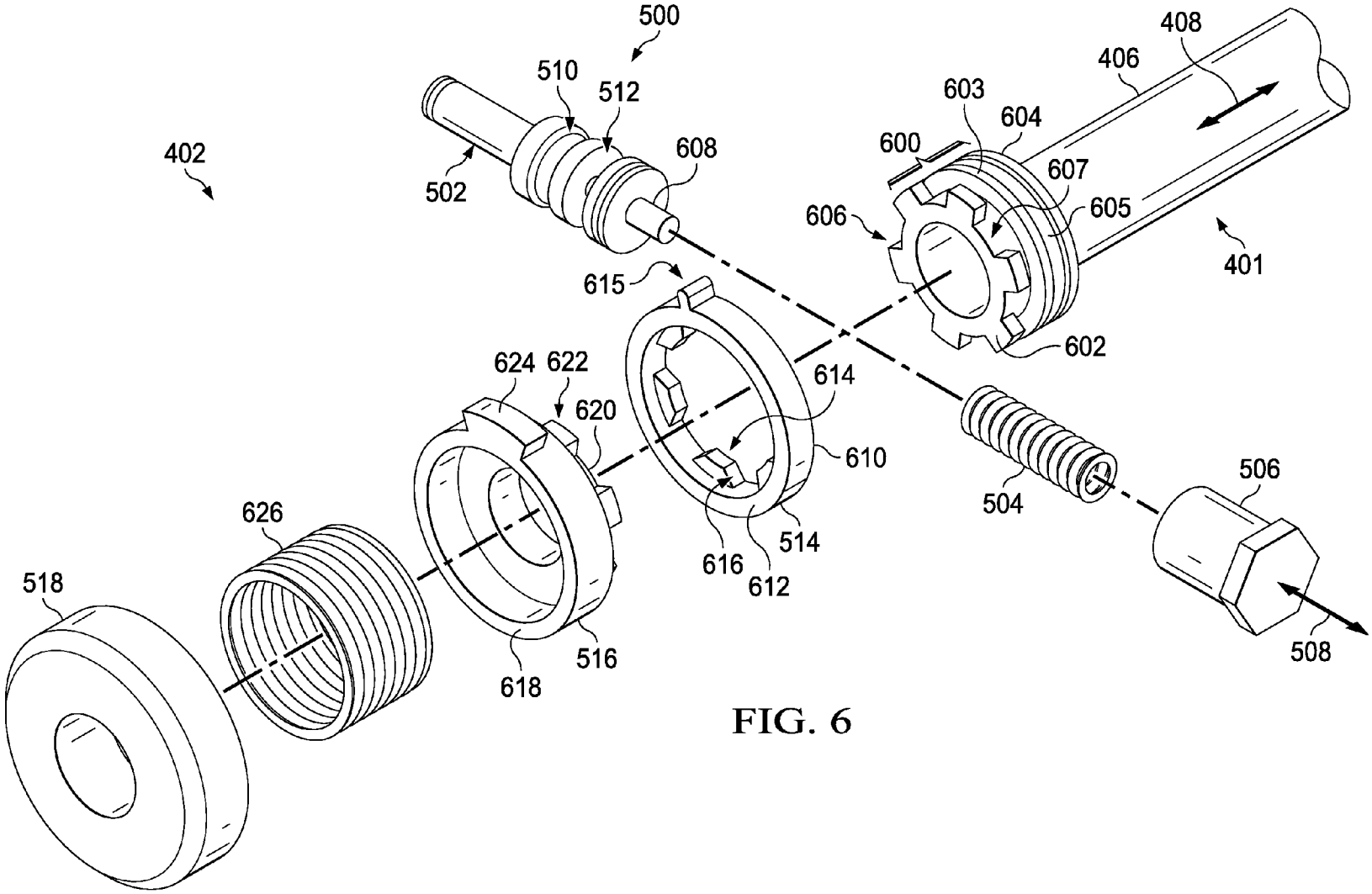
FIG. 6 is an illustration of an exploded isometric view of an actuator system without a housing in accordance with an illustrative embodiment.

With reference now to FIG. 6, an illustration of an exploded isometric view of actuator system 400 from FIG. 5 without housing 404 is depicted in accordance with an illustrative embodiment. As depicted, piston 406 has lockable portion 600. Lockable portion 600 may be an example of one implementation for lockable portion 324 in FIG. 3.

Lockable portion 600 includes first flange 602, second flange 603, and third flange 604. First flange 602, second flange 603, and third flange 604 may be examples of implementations for first flange 326, second flange 328, and third flange 330, respectively in FIG. 3. In this illustrative example, seal 605 is located between second flange 603 and third flange 604. First flange 602 is formed by first teeth 606. First teeth 606 may be an example of one implementation for first number of features 332 in FIG. 3. Groove 607 is formed between first flange 602 and second flange 603.

In this illustrative example, movable member 502 has elongated feature 608. Elongated feature 608 is configured to receive relock spring 504.

As depicted, lock collar 514 has first side 610 and second side 612. Lock collar 514 has second teeth 614 associated with first side 610 of lock collar 514. Second teeth 614 may be an example of one implementation for second number of features 346 in FIG. 3.

Second teeth 614 are configured to engage first teeth 606 to lock actuator device 401. In particular, second teeth 614 may engage first teeth 606 to prevent piston 406 from being allowed to translate along center axis 408. Gaps 616 are present between second teeth 614.

Further, lock collar 514 has rotatable feature 615. Rotatable feature 615 may be an example of one implementation for rotatable feature 351 in FIG. 3. Rotatable feature 615 may be received within retaining feature 510 of movable member 502. Rotatable feature 615 is used to move lock collar 514 between a lock position and an unlock position, similar to lock position 348 and unlock position 350, respectively, in FIG. 3.

As depicted, following collar 516 has first side 618 and second side 620. Third teeth 622 are associated with second side 620 of following collar 516. Third teeth 622 may be an example of one implementation for third number of features 362 in FIG. 3. Third teeth 622 may be interlocked with second teeth 614 of lock collar 514 to prevent lock collar 514 from rotating about center axis 408.

Further, tab 624 is associated with following collar 516. Tab 624 may be an example of one implementation for tab 368 in FIG. 3. Tab 368 may be used to prevent following collar 516 from rotating about center axis 408.

In this illustrative example, following spring 626 is shown. Following spring 626 may be an example of one implementation for following biasing element 364 in FIG. 3. Following spring 626 is a compression spring configured to compress against stop member 518 when a load is applied to following spring 626 and extend to exert a force on following collar 516 in a direction towards lock collar 514 when the load applied to following spring 626 is reduced or absent.

Figure 7:
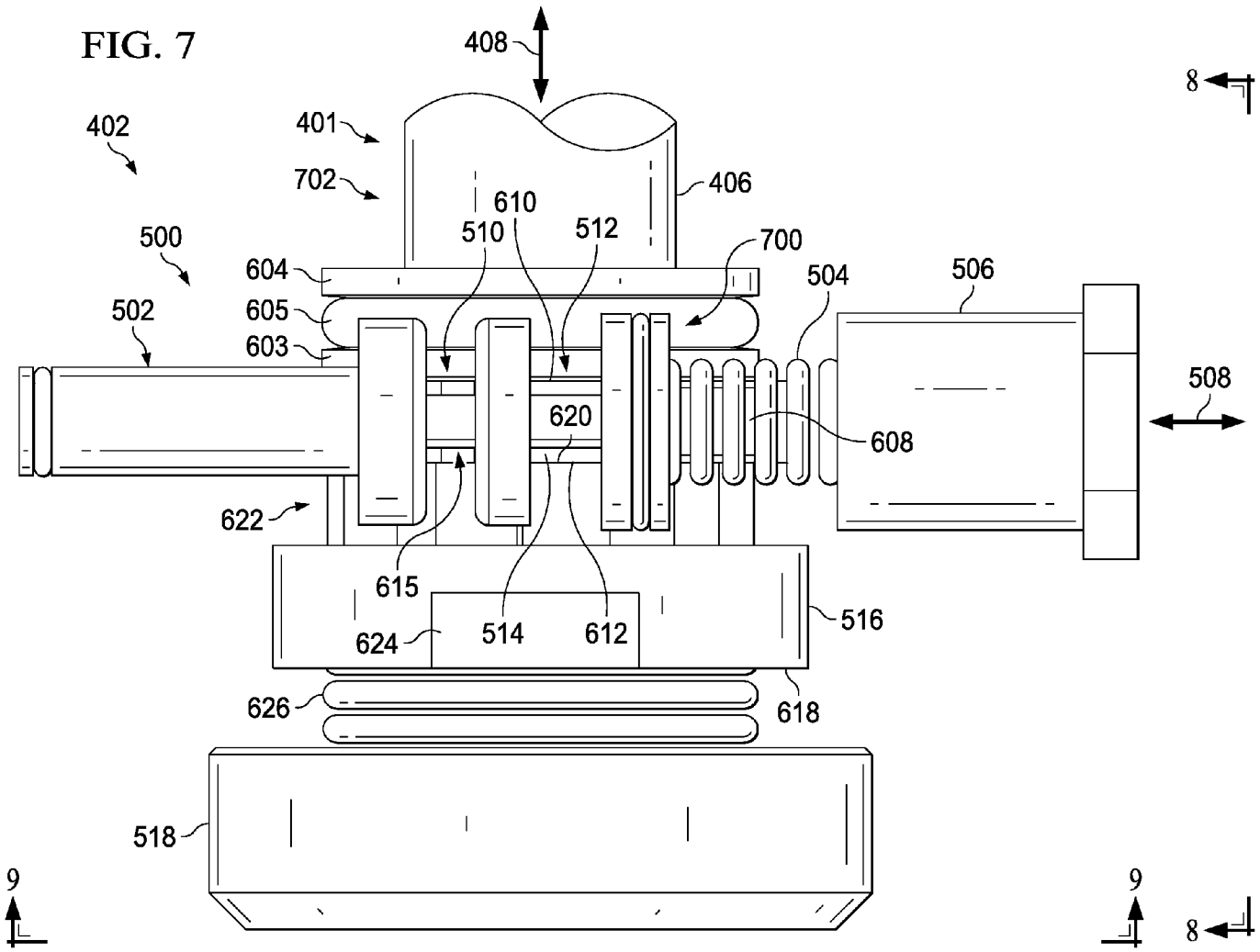
FIG. 7 is an illustration of a top view of a portion of an actuator system without a housing in accordance with an illustrative embodiment.

With reference now to FIG. 7, an illustration of a top view of portion 416 of actuator system 400 from FIGS. 4-6 without housing 404 is depicted in accordance with an illustrative embodiment. In this illustrative example, rotatable feature 615 on lock collar 514 is shown retained by retaining feature 510 of movable member 502.

In this illustrative example, lock collar 514 is in lock position 700 such that actuator device 401 is in locked state 702. In lock position 700, lock collar 514 sits within groove 607.

Figure 8:
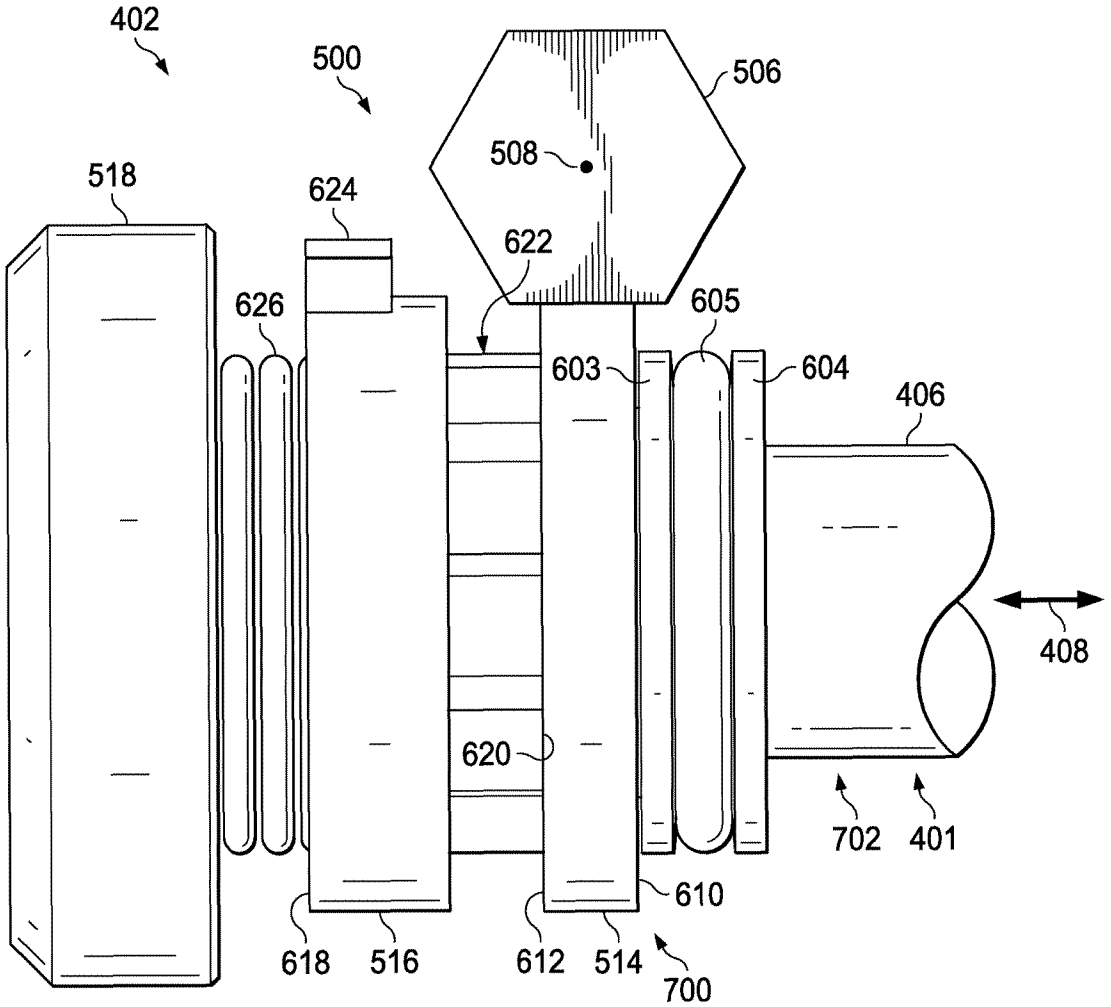
FIG. 8 is an illustration of a side view of a portion of an actuator system in accordance with an illustrative embodiment.

With reference now to FIG. 8, an illustration of a side view of portion 416 of actuator system 400 from FIG. 7 is depicted in accordance with an illustrative embodiment. In this illustrative example, a side view of portion 416 is depicted taken in the direction of lines 8-8 in FIG. 7. Lock collar 514 is in lock position 700 such that actuator device 401 is in locked state 702.

Figure 9:
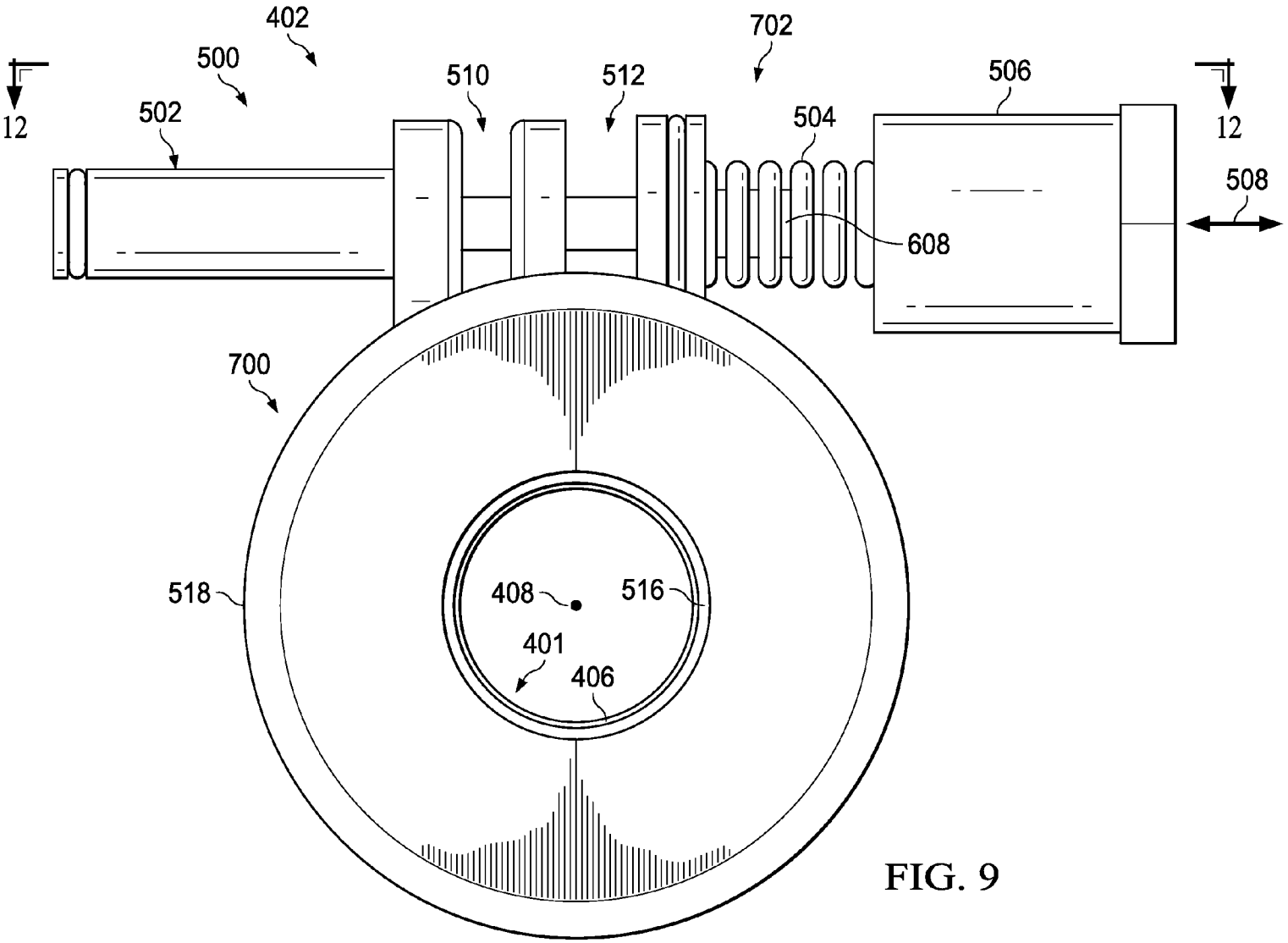
FIG. 9 is an illustration of an end view of a portion of an actuator system in accordance with an illustrative embodiment.

With reference now to FIG. 9, an illustration of an end view of portion 416 of actuator system 400 from FIG. 7 is depicted in accordance with an illustrative embodiment. In this illustrative example, a side view of portion 416 is depicted taken in the direction of lines 9-9 in FIG. 7.

Figure 10:
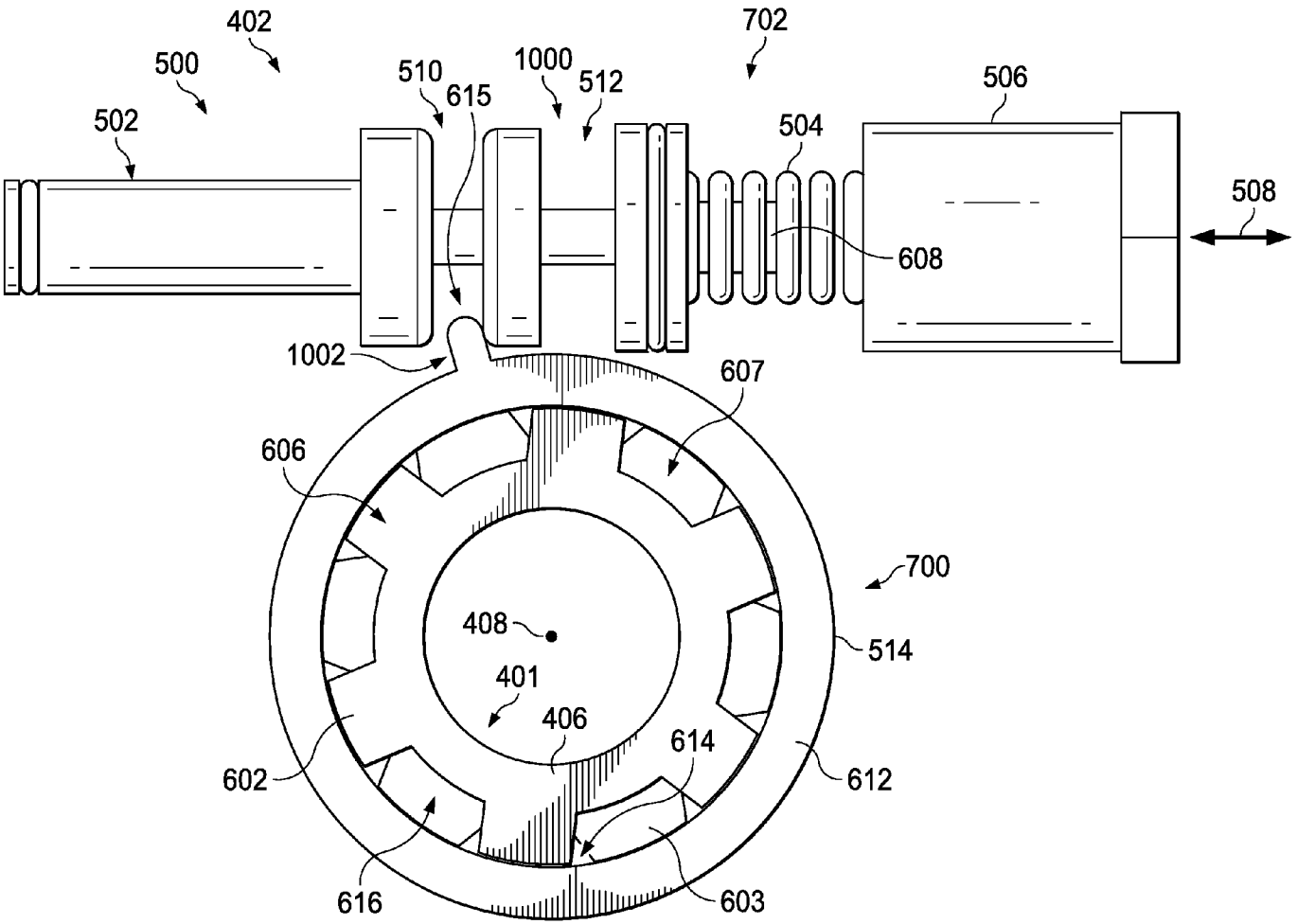
FIG. 10 is an illustration of an end view of a portion of an actuator system without a following collar, a stop member, and a following spring in accordance with an illustrative embodiment.

With reference now to FIG. 10, an illustration of an end view of portion 416 of actuator system 400 from FIG. 9 without following collar 516, stop member 518, and following spring 626 from FIGS. 5-6 is depicted in accordance with an illustrative embodiment. In this illustrative example, lock collar 514 is in lock position 700.

In lock position 700, second teeth 614 of lock collar 514 may be engaged with first teeth 606 of lockable portion 600 of piston 406 such that second teeth 614 are at least partially aligned with first teeth 606. In this illustrative example, second teeth 614 are located directly behind first teeth 606 such that piston 406 may not be movable along center axis 408.

Further, movable member 502 is in initial position 1000 such that rotatable feature 615 is held at first position 1002. When rotatable feature 615 is at first position 1002, lock collar 514 is in lock position 700. Movable member 502 may be moved along center axis 508 to move rotatable feature 615 to move lock collar 514 from lock position 700 to an unlock position.

Figure 11:
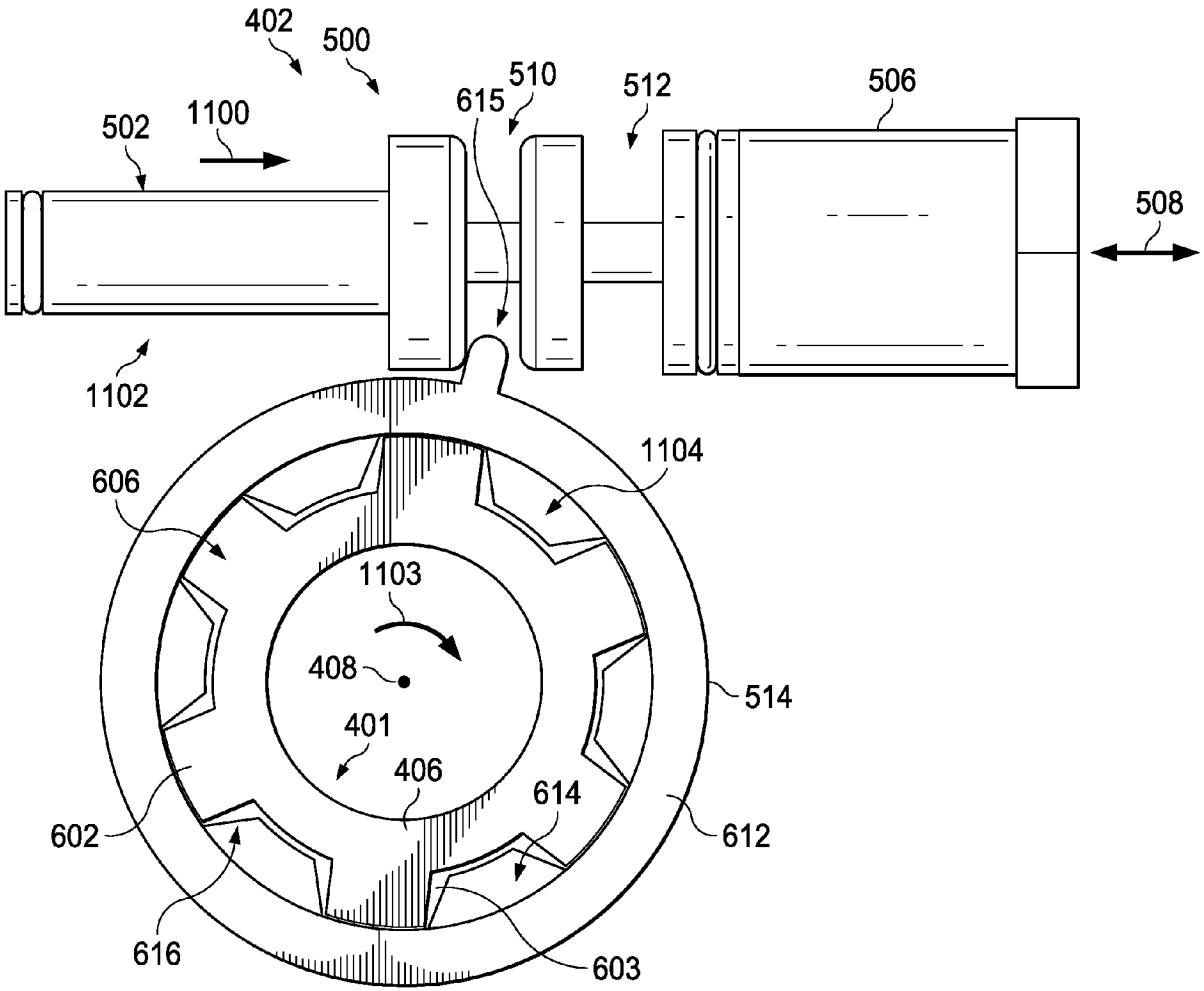
FIG. 11 is an illustration of an end view of a portion of an actuator system with a lock collar moved into an unlock position in accordance with an illustrative embodiment.

With reference now to FIG. 11, an illustration of an end view of portion 416 of actuator system 400 from FIG. 10 with lock collar 514 moved into an unlock position is depicted in accordance with an illustrative embodiment. In this illustrative example, movable member 502 has been moved in the direction of arrow 1100 along center axis 508 from initial position 1000 in FIG. 10 to final position 1102.

Movement of movable member 502 along center axis 508 causes rotatable feature 615 to rotate in the direction of arrow 1103 about center axis 408 to move lock collar 514 into unlock position 1104. In unlock position 1104, second teeth 614 are completely unaligned with first teeth 606. Thus, piston 406 is allowed to translate along center axis 408.

Figure 12:
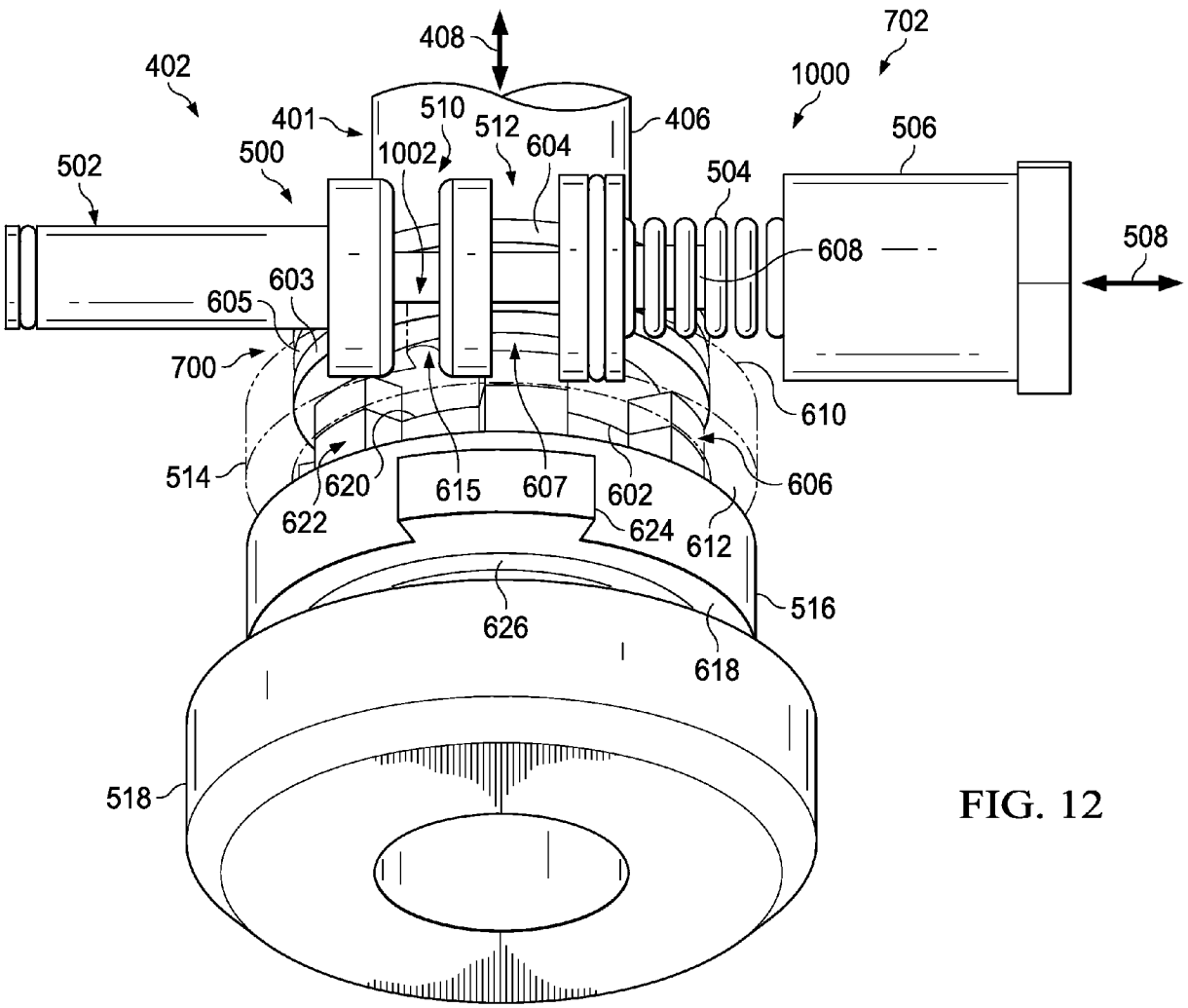
FIG. 12 is an illustration of an isometric top view of a portion of an actuator system in accordance with an illustrative embodiment.

With reference now to FIG. 12, an illustration of an isometric top view of portion 416 of actuator system 400 from FIG. 9 is depicted in accordance with an illustrative embodiment. In this illustrative example, an isometric top view of portion 416 is depicted taken in the direction of lines 12-12 in FIG. 9.

In this illustrative example, lock collar 514 is shown in phantom. Lock collar 514 is in lock position 700. In lock position 700, following collar 516 may be positioned relative to lock collar 514 such that third teeth 622 of following collar 516 are substantially engaged with second teeth 614 of lock collar 514. In particular, third teeth 622 are aligned with second teeth 614 such that second teeth 614 are located directly behind third teeth 622.

Figure 13:
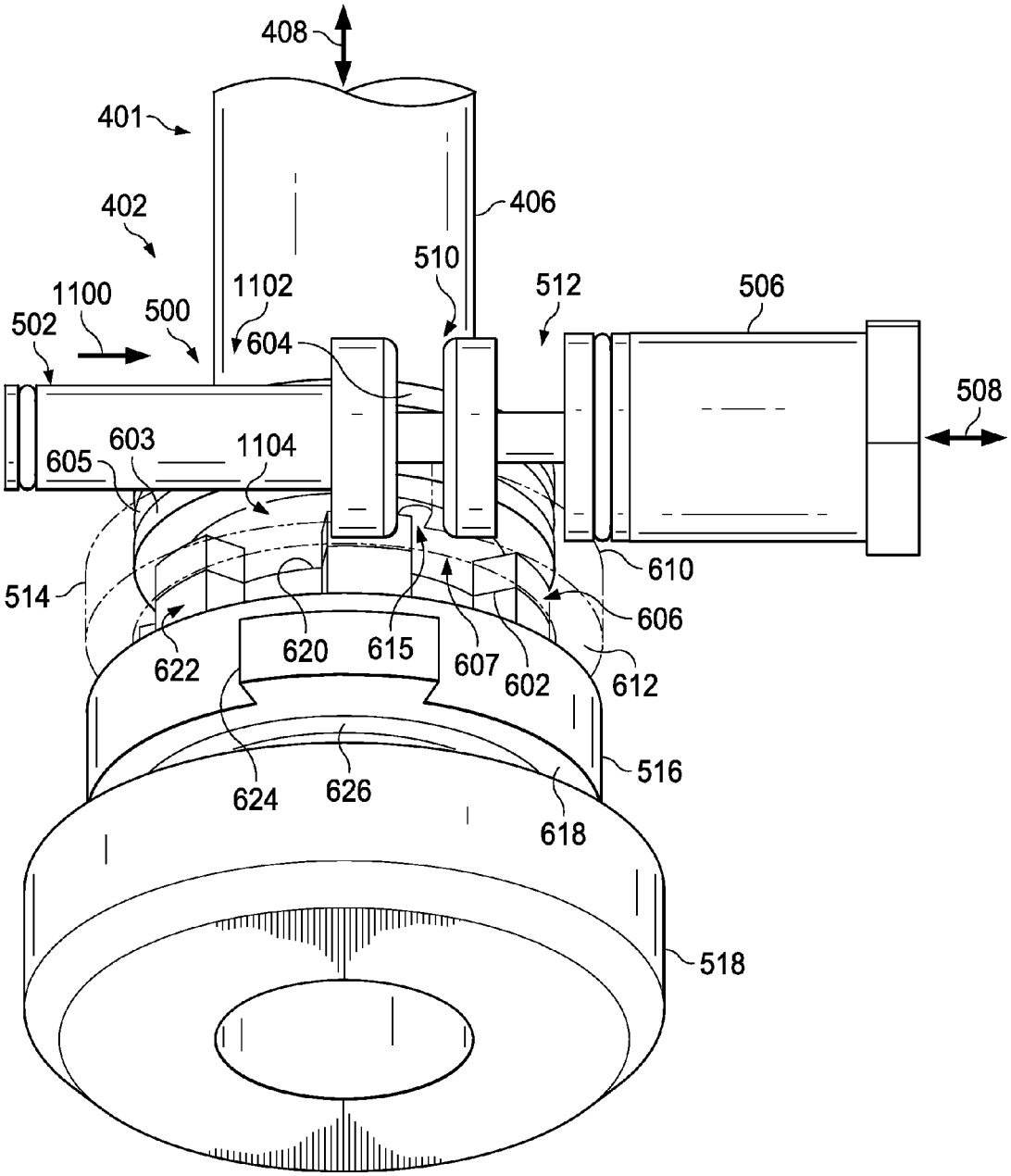
FIG. 13 is an illustration of a portion of an actuator system with a lock collar moved to an unlock position in accordance with an illustrative embodiment.

With reference now to FIG. 13, an illustration of portion 416 of actuator system 400 from FIG. 12 with lock collar 514 moved to unlock position 1104 from FIG. 11 is depicted in accordance with an illustrative embodiment. Lock collar 514 has been rotated from lock position 700 in FIG. 7 to unlock position 1104. As depicted, third teeth 622 of following collar 516 are now completely unaligned with second teeth 614 of lock collar 514.

Figure 14:
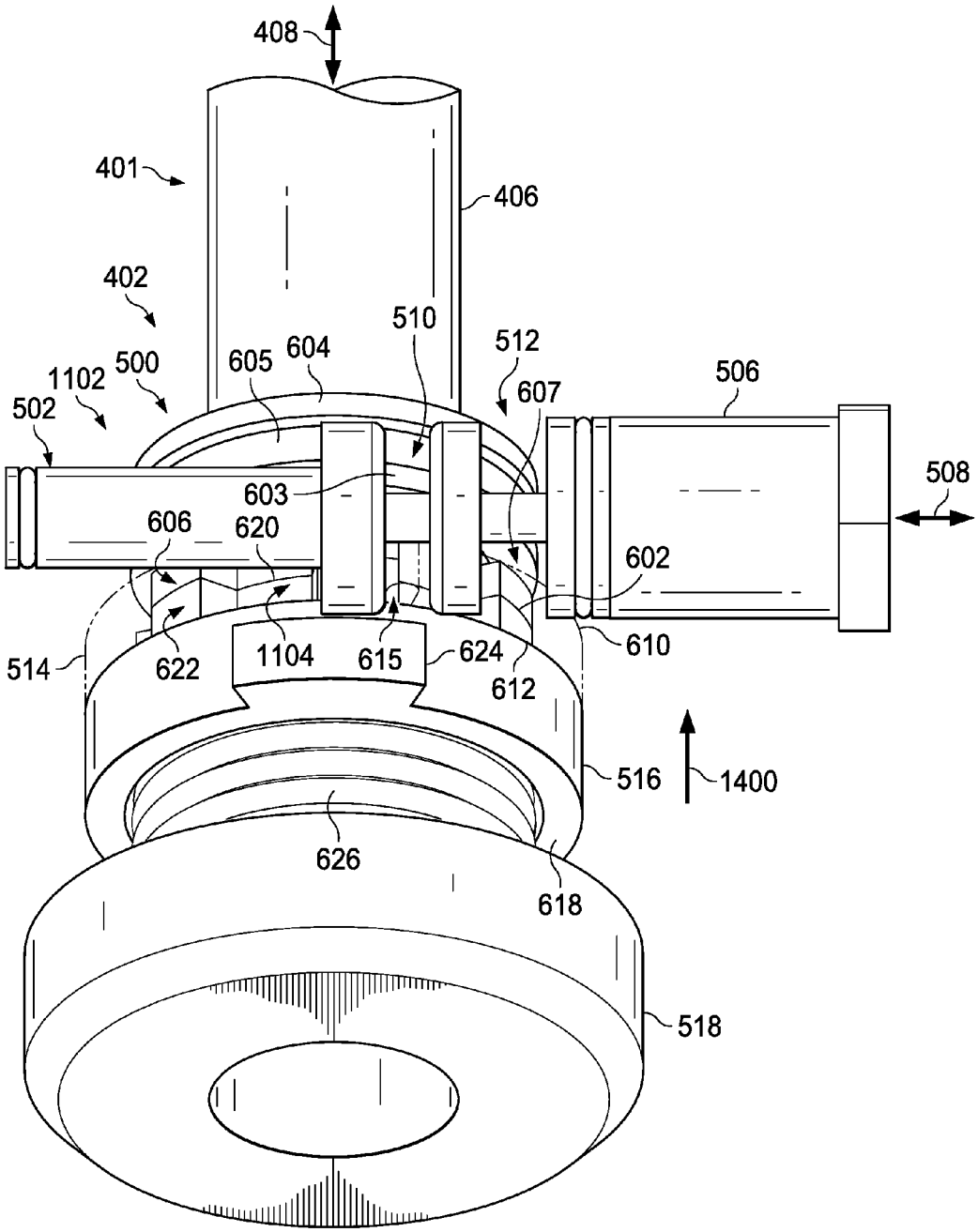
FIG. 14 is an illustration of a portion of an actuator system with third teeth interlocked with second teeth in accordance with an illustrative embodiment.

With reference now to FIG. 14, an illustration of portion 416 of actuator system 400 from FIG. 13 with third teeth 622 interlocked with second teeth 614 is depicted in accordance with an illustrative embodiment. Piston 406 has moved in the direction of arrow 1400. Movement of piston 406 in the direction of arrow 1400 and movement of lock collar 514 into unlock position 1104 such that third teeth 622 are no longer aligned with second teeth 614 reduces the load applied to following spring 626 such that following spring 626 extends in the direction of arrow 1400.

This extension of following spring 626 causes following collar 516 to move in the direction of arrow 1400 such that third teeth 622 interlock with second teeth 614. In particular, third teeth 622 enter gaps 616 between second teeth 614.

Figure 15:
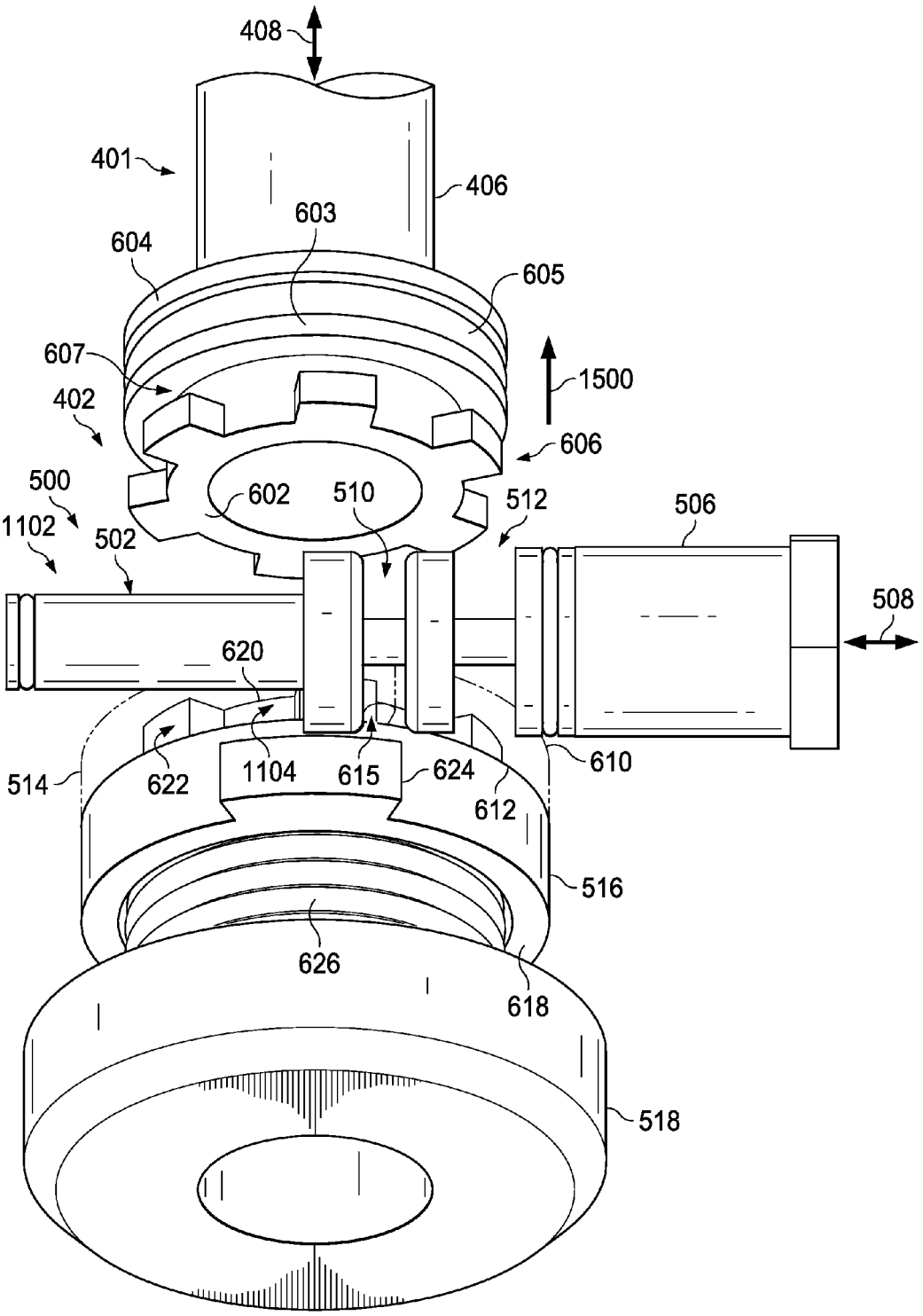
FIG. 15 is an illustration of a portion of an actuator system with a piston translated in a desired direction in accordance with an illustrative embodiment.

With reference now to FIG. 15, an illustration of portion 416 of actuator system 400 from FIG. 14 with piston 406 translated in a desired direction is depicted in accordance with an illustrative embodiment. In this illustrative example, piston 406 has been further moved in desired direction 1500 away from lock collar 514. Third teeth 622 of following collar 516 remain interlocked with second teeth 614 of lock collar 514 to prevent lock collar 514 from rotating back into lock position 700 in FIG. 12.

Figure 16:
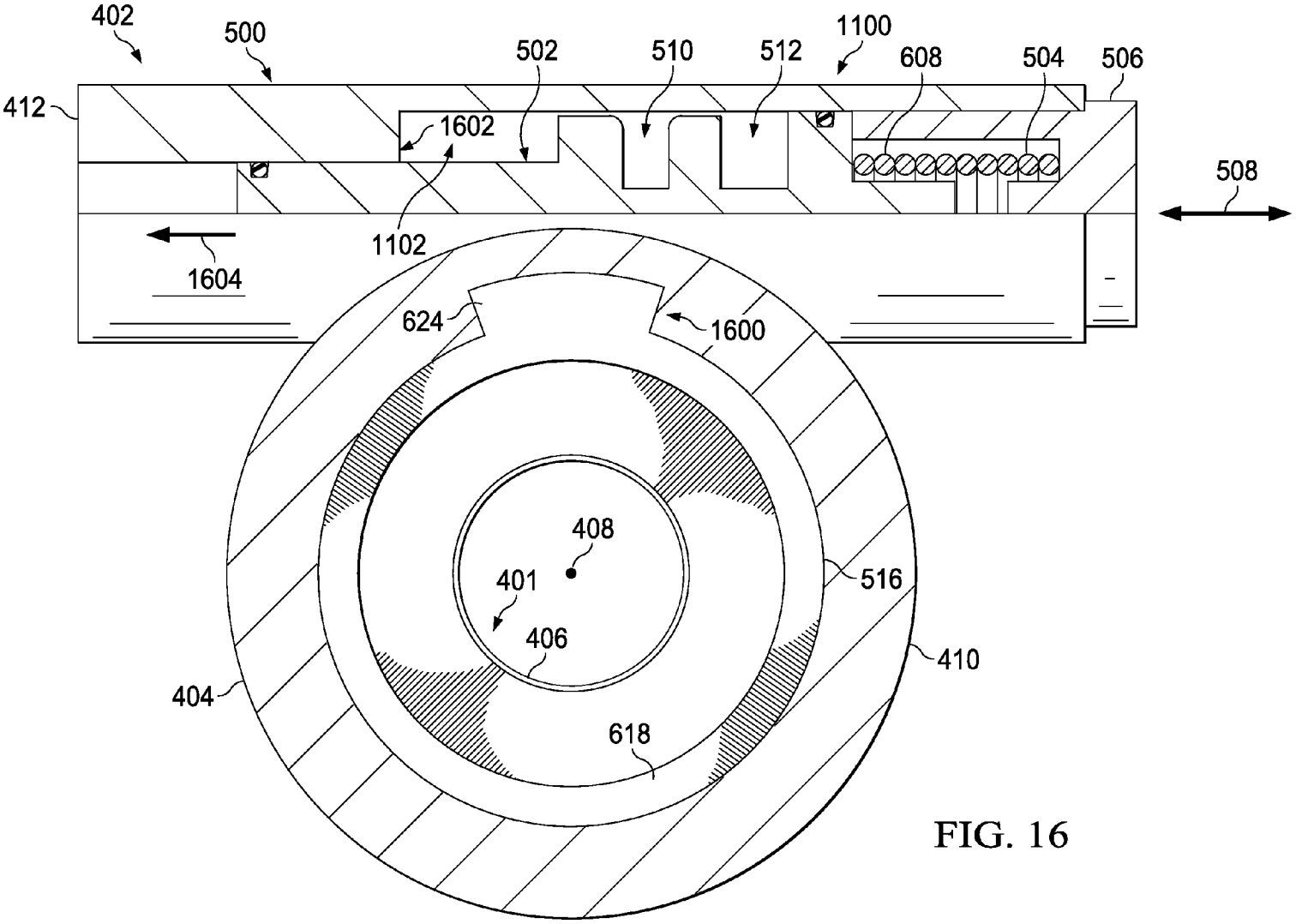
FIG. 16 is an illustration of a cross-sectional end view of a portion of an actuator system with a housing in accordance with an illustrative embodiment.

With reference now to FIG. 16, an illustration of a cross-sectional end view of portion 416 of actuator system 400 with housing 404 from FIG. 4 is depicted in accordance with an illustrative embodiment. In this illustrative example, a cross-sectional end view of portion 416 is depicted taken in the direction of lines 16-16 in FIG. 4. In FIG. 16, stop member 518 and following spring 626 are not shown such that tab 624 of following collar 516 may be seen.

As depicted, second structure 410 of housing 404 may have slot 1600 configured to receive tab 624. Slot 1600 prevents tab 624 from being rotated about center axis 408. In this manner, tab 624 and slot 1600 prevent rotation of following collar 516 about center axis 408.

In this illustrative example, third structure 412 of housing 404 may have stop feature 1602. Stop feature 1602 is formed by a portion of the inner wall of housing 404. Stop feature 1602 may be configured to limit movement of lock piston 502 in the direction of arrow 1604.

Figure 17:
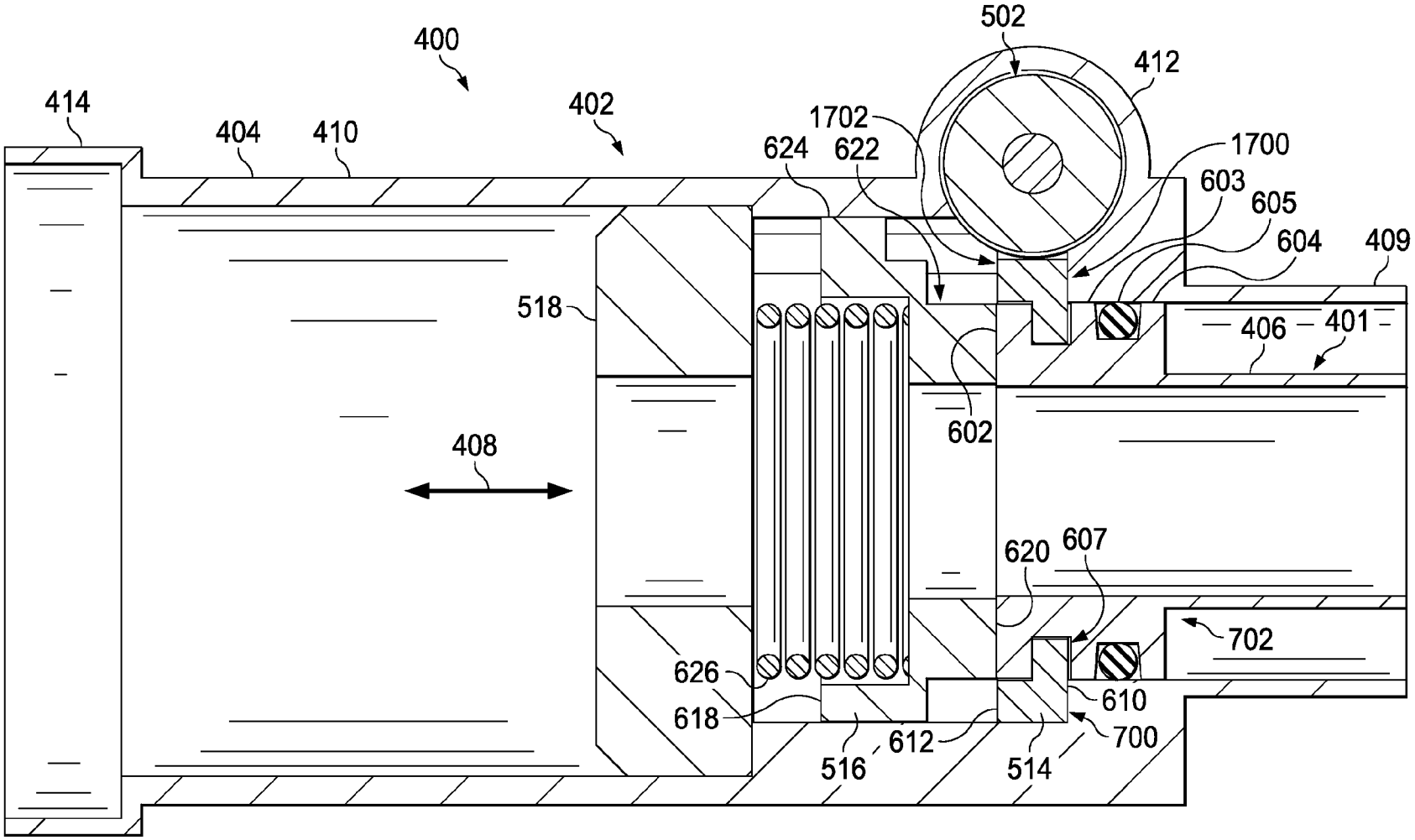
FIG. 17 is an illustration of a cross-sectional end view of a portion of an actuator system with a housing in accordance with an illustrative embodiment.

With reference now to FIG. 17, an illustration of a cross-sectional end view of portion 416 of actuator system 400 with housing 404 from FIG. 4 is depicted in accordance with an illustrative embodiment. In this illustrative example, a cross-sectional end view of portion 416 is depicted taken in the direction of lines 17-17 in FIG. 4.

In this illustrative example, third structure 412 of housing 404 may have stop feature 1700 and stop feature 1702. Stop feature 1700 may be configured to retain lock collar 514 such that lock collar 514 may be unable to move in a direction along center axis 408.

The illustrations of actuator system 400 and portion 416 in FIGS. 4-17 are not meant to imply physical or architectural limitations to the manner in which an illustrative embodiment may be implemented. Other components in addition to or in place of the ones illustrated may be used. Some components may be optional.

The different components shown in FIGS. 4-17 may be illustrative examples of how components shown in block form in FIG. 3 can be implemented as physical structures. Additionally, some of the components in FIGS. 4-17 may be combined with components in FIG. 3, used with components in FIG. 3, or a combination of the two.

Figure 18:
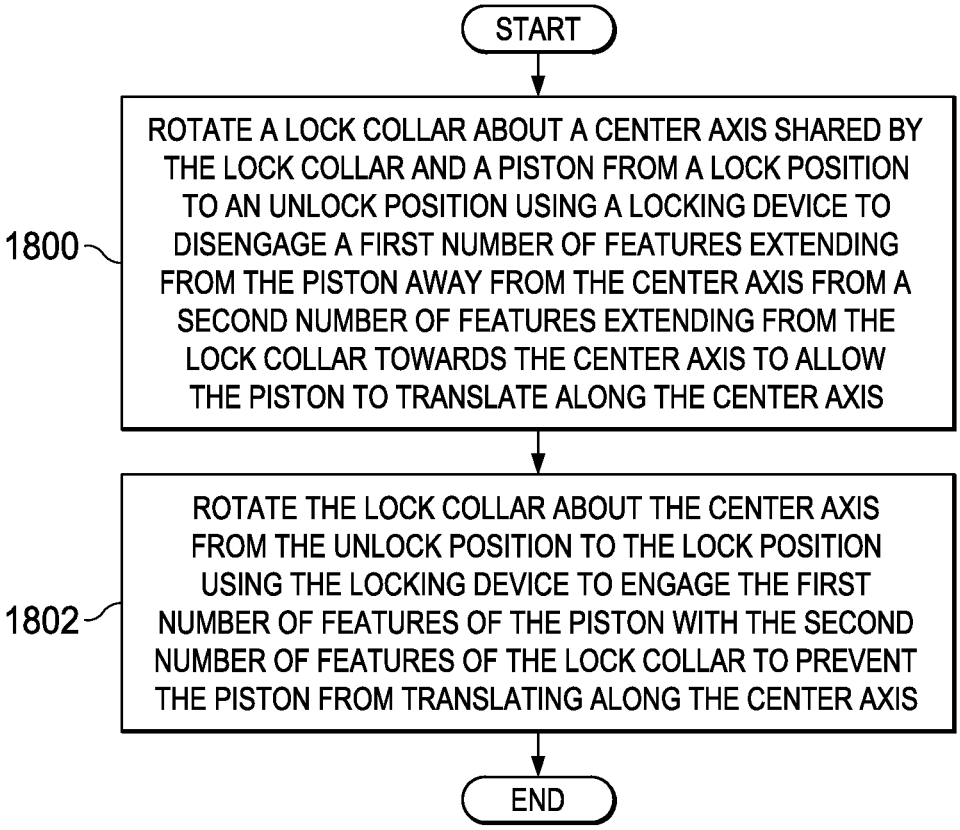
FIG. 18 is an illustration of a process for operating a locking system for an actuator device in the form of a flowchart in accordance with an illustrative embodiment.

With reference now to FIG. 18, an illustration of a process for operating a locking system for an actuator device is depicted in the form of a flowchart in accordance with an illustrative embodiment. The process illustrated in FIG. 18 may be used to operate, for example, locking system 308 in FIG. 3.

The process begins by rotating a lock collar about a center axis shared by the lock collar and a piston from a lock position to an unlock position using a locking device to disengage a first number of features extending from the piston away from the center axis from a second number of features extending from the lock collar towards the center axis to allow the piston to translate along the center axis (operation 1800). In operation 1800, when the first number of features of the piston is disengaged from the second number of features of the lock collar, the second number of features of the lock collar is also considered disengaged from the first number of features of the piston. In one illustrative example, the first number of features and the second number of features may be a first number of teeth and a second number of teeth, respectively.

Thereafter, the lock collar is rotated about the center axis from the unlock position to the lock position using the locking device to engage the first number of features of the piston with the second number of features of the lock collar to prevent the piston from translating along the center axis (operation 1802), with the process terminating thereafter. In operation 1802, when the first number of features of the piston is engaged with the second number of features of the lock collar, the second number of features of the lock collar is also considered engaged with the first number of features of the piston.

Figure 19:
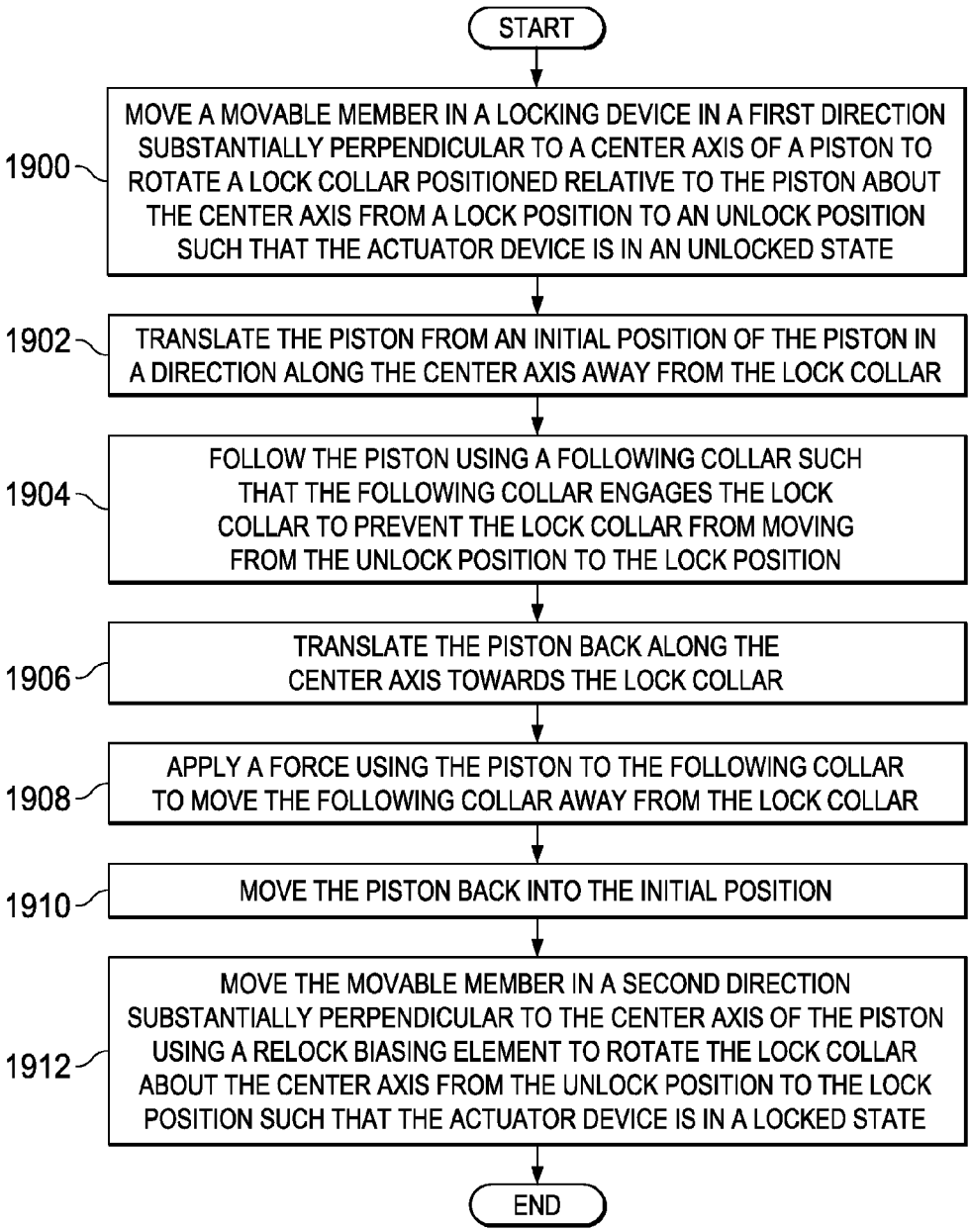
FIG. 19 is an illustration of a process for moving an actuator device between a locked state and an unlocked state in the form of a flowchart in accordance with an illustrative embodiment.

With reference now to FIG. 19, an illustration of a process for moving an actuator device between a locked state and an unlocked state is depicted in the form of a flowchart in accordance with an illustrative embodiment. The process illustrated in FIG. 19 may be used to operate, for example, locking system 308 in FIG. 3 to move actuator device 306 between an unlocked state and a locked state.

The process begins by moving a movable member in a locking device in a first direction substantially perpendicular to a center axis of a piston to rotate a lock collar positioned relative to the piston about the center axis from a lock position to an unlock position such that the actuator device is in an unlocked state (operation 1900). Next, the piston is translated from an initial position of the piston in a direction along the center axis away from the lock collar (operation 1902). A following collar follows the piston such that the following collar engages the lock collar to prevent the lock collar from moving from the unlock position to the lock position (operation 1904).

Thereafter, the piston is translated back along the center axis towards the lock collar (operation 1906). The piston applies a force to the following collar to move the following collar away from the lock collar (operation 1908). The piston is moved back into the initial position (operation 1910).

The movable member is then moved in a second direction substantially perpendicular to the center axis of the piston using a relock biasing element to rotate the lock collar about the center axis from the unlock position to the lock position such that the actuator device is in a locked state (operation 1912), with the process terminating thereafter.

The flowcharts and block diagrams in the different depicted embodiments illustrate the architecture, functionality, and operation of some possible implementations of apparatuses and methods in an illustrative embodiment. In this regard, each block in the flowcharts or block diagrams may represent a module, a segment, a function, a portion of an operation or step, some combination thereof.

In some alternative implementations of an illustrative embodiment, the function or functions noted in the blocks may occur out of the order noted in the figures. For example, in some cases, two blocks shown in succession may be executed substantially concurrently, or the blocks may sometimes be performed in the reverse order, depending upon the functionality involved. Also, other blocks may be added in addition to the illustrated blocks in a flowchart or block diagram.

Figure 20:
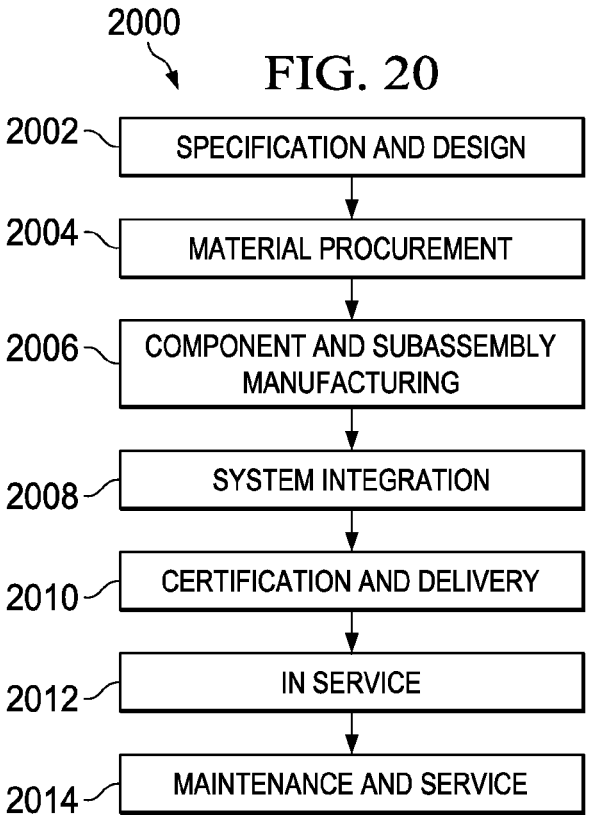
FIG. 20 is an illustration of an aircraft manufacturing and service method in the form of a block diagram in accordance with an illustrative embodiment.
Figure 21:
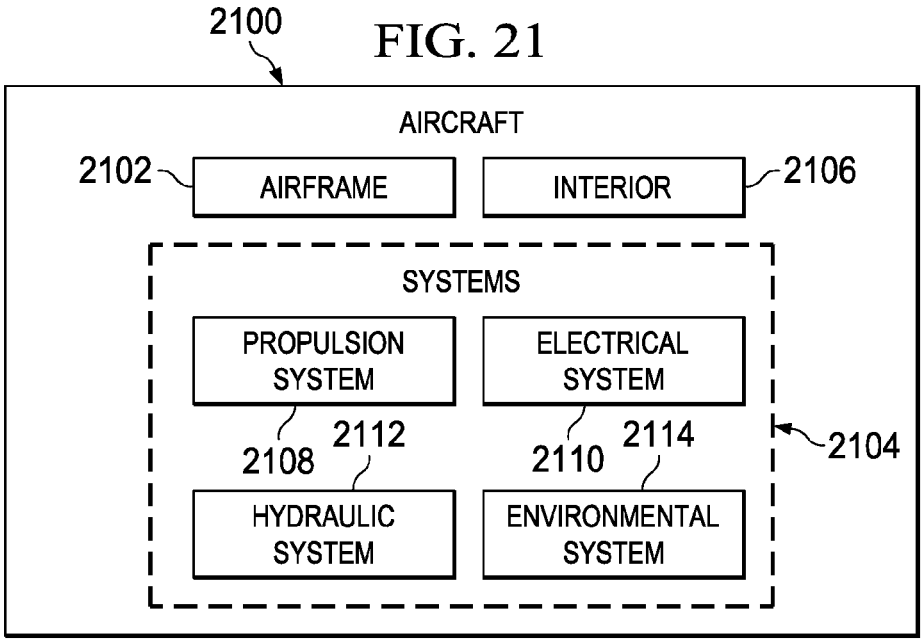
FIG. 21 is an illustration of an aircraft in the form of a block diagram in which an illustrative embodiment may be implemented.

Illustrative embodiments of the disclosure may be described in the context of aircraft manufacturing and service method 2000 as shown in FIG. 20 and aircraft 2100 as shown in FIG. 21. Turning first to FIG. 20, an illustration of an aircraft manufacturing and service method is depicted in the form of a block diagram in accordance with an illustrative embodiment. During pre-production, aircraft manufacturing and service method 2000 may include specification and design 2002 of aircraft 2100 in FIG. 21 and material procurement 2004.

During production, component and subassembly manufacturing 2006 and system integration 2008 of aircraft 2100 in FIG. 21 takes place. Thereafter, aircraft 2100 in FIG. 21 may go through certification and delivery 2010 in order to be placed in service 2012. While in service 2012 by a customer, aircraft 2100 in FIG. 21 is scheduled for routine maintenance and service 2014, which may include modification, reconfiguration, refurbishment, and other maintenance or service.

Each of the processes of aircraft manufacturing and service method 2000 may be performed or carried out by at least one of a system integrator, a third party, or an operator. In these examples, the operator may be a customer. For the purposes of this description, a system integrator may include, without limitation, any number of aircraft manufacturers and major-system subcontractors; a third party may include, without limitation, any number of vendors, subcontractors, and suppliers; and an operator may be an airline, a leasing company, a military entity, a service organization, and so on.

With reference now to FIG. 21, an illustration of an aircraft is depicted in the form of a block diagram in which an illustrative embodiment may be implemented. In this example, aircraft 2100 is produced by aircraft manufacturing and service method 2000 in FIG. 20 and may include airframe 2102 with plurality of systems 2104 and interior 2106. Examples of systems 2104 include one or more of propulsion system 2108, electrical system 2110, hydraulic system 2112, and environmental system 2114. Any number of other systems may be included. Although an aerospace example is shown, different illustrative embodiments may be applied to other industries, such as the automotive industry.

Apparatuses and methods embodied herein may be employed during at least one of the stages of aircraft manufacturing and service method 2000 in FIG. 20. In particular, actuator system 300 from FIG. 3 may be manufactured or installed in aircraft 2100 during any one of the stages of aircraft manufacturing and service method 2000. For example, without limitation, actuator system 300 from FIG. 3 may be installed in propulsion system 2108 of aircraft 2100 during at least one of component and subassembly manufacturing 2006, system integration 2008, routine maintenance and service 2014, or some other stage of aircraft manufacturing and service method 2000. Still further, actuator system 300 from FIG. 3 may be used in other parts of aircraft 2100, such as hydraulic system 2112, environmental system 2114, or electrical system 2110.

In one illustrative example, components or subassemblies produced in component and subassembly manufacturing 2006 in FIG. 20 may be fabricated or manufactured in a manner similar to components or subassemblies produced while aircraft 2100 is in service 2012 in FIG. 20. As yet another example, one or more apparatus embodiments, method embodiments, or a combination thereof may be utilized during production stages, such as component and subassembly manufacturing 2006 and system integration 2008 in FIG. 20. One or more apparatus embodiments, method embodiments, or a combination thereof may be utilized while aircraft 2100 is in service 2012, during maintenance and service 2014 in FIG. 20, or both. The use of a number of the different illustrative embodiments may substantially expedite the assembly of and reduce the cost of aircraft 2100.

The description of the different illustrative embodiments has been presented for purposes of illustration and description, and is not intended to be exhaustive or limited to the embodiments in the form disclosed. Many modifications and variations will be apparent to those of ordinary skill in the art. Further, different illustrative embodiments may provide different features as compared to other desirable embodiments. The embodiment or embodiments selected are chosen and described in order to best explain the principles of the embodiments, the practical application, and to enable others of ordinary skill in the art to understand the disclosure for various embodiments with various modifications as are suited to the particular use contemplated.

What is claimed is:

1. An apparatus comprising:

a lock collar that shares a center axis with a piston having a first number of features that extend from the piston away from the center axis of the piston, wherein the lock collar has a second number of features located at a first side of the lock collar that extend towards the center axis, and wherein the lock collar further comprises a single rotatable feature projecting radially outwardly from the lock collar;

a locking device configured to rotate the lock collar between a lock position in which the second number of features of the lock collar is engaged with the first number of features of the piston and an unlock position in which the second number of features of the lock collar is disengaged from the first number of features of the piston, wherein the locking device further comprises a movable member, wherein movement of the movable member in a first direction along a transverse axis substantially perpendicular to the center axis rotates the lock collar about the center axis from the lock position to the unlock position and wherein movement of the movable member in a second direction along the transverse axis substantially perpendicular to the center axis rotates the lock collar about the center axis from the unlock position to the lock position;

a following biasing element; and a following collar positioned relative to the lock collar such that the following collar shares the center axis with the lock collar and the piston, wherein the following biasing element causes the following collar to follow the piston when the piston translates to prevent the lock collar from rotating about the center axis from the unlock position to the lock position;

wherein the following collar comprises a third number of features configured to extend from the following collar away from the center axis and configured to prevent the lock collar from rotating about the center axis from the unlock position to the lock position when the first number of features of the piston is located at the first side of the lock collar; and wherein the movable member further comprises a radial slot into which the single rotatable feature projects, such that translation of the movable member along the transverse axis is configured to force the single rotatable feature against one of two sides of the radial slot, which in turn is configured to force the lock collar to rotate about the center axis.

2. The apparatus of claim 1, wherein the piston is allowed to translate along the center axis when the lock collar is in the unlock position and prevented from translating along the center axis when the lock collar is in the lock position.

3. The apparatus of claim 1 further comprising:

wherein the piston is part of an actuator device and has zero degrees of rotational freedom with respect to the center axis.

4. The apparatus of claim 1, wherein the locking device further comprises:

a relock biasing element associated with the movable member, wherein the movement of the movable member in the first direction applies a load to the relock biasing element and wherein the relock biasing element moves the movable member in the second direction to rotate the lock collar about the center axis from the unlock position to the lock position in response to the load no longer being applied to the relock biasing element.

5. The apparatus of claim 4, wherein the relock biasing element is a compression spring.

6. The apparatus of claim 1, wherein the second number of features of the lock collar engage the first number of features of the piston at a second side of the lock collar.

7. The apparatus of claim 6, wherein rotation of the lock collar about the center axis from the lock position to the unlock position rotates the second number of features of the lock collar to disengage from the first number of features of the piston such that the piston is allowed to translate along the center axis.

8. The apparatus of claim 1, wherein the following biasing element is a compression spring that compresses against a cylindrical stop member when a piston load is applied to the following spring and that exerts a force on the following collar when the piston load applied to the compression spring is reduced or absent.

9. The apparatus of claim 1, wherein the first number of features is a first number of teeth, the second number of features is a second number of teeth, and the third number of features is a third number of teeth.

10. The apparatus of claim 1, wherein the following collar comprises:

a tab configured for use in preventing the following collar from rotating about the center axis.

11. The apparatus of claim 1, further comprising:

a housing, wherein the lock collar, the following collar, and the locking device are located within the housing.

12. The apparatus of claim 11, wherein the housing comprises:

a slot configured to receive a tab associated with the following collar such that the tab has zero degrees of rotational freedom with respect to the center axis.

13. An actuator system comprising:

a piston having a first number of teeth that extend from the piston away from a center axis of the piston;

a lock collar positioned relative to the piston such that the lock collar and the piston share the center axis, wherein the lock collar has a second number of teeth that extend from the lock collar towards the center axis, and wherein the lock collar further comprises a single rotatable feature projecting radially outwardly from the lock collar;

a locking device configured to rotate the lock collar between a lock position in which the second number of teeth of the lock collar is engaged with the first number of teeth of the piston and an unlock position in which the second number of teeth of the lock collar is disengaged from the first number of teeth of the piston, wherein the piston is allowed to translate along the center axis when the lock collar is in the unlock position and prevented from translating along the center axis when the lock collar is in the lock position; wherein the locking device comprises a second piston arranged transversely with respect to the center axis, wherein movement of the second piston in a first direction along a transverse axis substantially perpendicular to the center axis rotates the lock collar about the center axis from the lock position to the unlock position and wherein movement of the second piston in a second direction along the transverse axis substantially perpendicular to the center axis rotates the lock collar about the center axis from the unlock position to the lock position, and wherein the second piston further comprises a radial slot into which the single rotatable feature projects, such that translation of a movable member along the transverse axis is configured to force the single rotatable feature against one of two sides of the radial slot, which in turn is configured to force the lock collar to rotate about the center axis;

a following biasing element; and a following collar positioned relative to the lock collar such that the following collar shares the center axis with the lock collar and the piston, wherein the following collar has a third number of teeth that extend from the following collar away from the center axis and wherein the following biasing element causes the following collar to follow the piston when the piston translates such that the third number of teeth of the following collar interlocks with the second number of teeth of the lock collar to prevent the lock collar from rotating about the center axis from the unlock position to the lock position;

wherein the following biasing element is a compression spring that compresses against a cylindrical stop member when a piston load is applied to the following spring and that exerts a force on the following collar when the piston load applied to the compression spring is reduced or absent.

14. A method for operating a locking system for an actuator device, the method comprising:

rotating a lock collar about a center axis shared by the lock collar and a piston from a lock position to an unlock position using a locking device to disengage a first number of features extending from the piston away from the center axis from a second number of features extending from the lock collar towards the center axis to allow the piston to translate along the center axis; and rotating the lock collar about the center axis from the unlock position to the lock position using the locking device to engage the first number of features of the piston with the second number of features of the lock collar to prevent the piston from translating along the center axis;

wherein rotating the lock collar about the center axis shared by the lock collar and the piston from the lock position to the unlock position comprises:

moving a movable member in the locking device in a first direction substantially perpendicular to the center axis to rotate the lock collar about the center axis from the lock position to the unlock position;

wherein moving the movable member in the locking device in the first direction substantially perpendicular to the center axis to rotate the lock collar about the center axis from the lock position to the unlock position comprises:

moving the movable member in the locking device in the first direction substantially perpendicular to the center axis to cause the first number of features extending from the piston away from the center axis to disengage the second number of features extending from the lock collar towards the center axis;

wherein rotating the lock collar about the center axis shared by the lock collar and the piston from the unlock position to the lock position comprises:

moving the movable member in a second direction substantially perpendicular to the center axis using a relock biasing element to rotate the lock collar about the center axis from the unlock position to the lock position;

wherein a following collar is positioned relative to the lock collar such that the following collar shares the center axis with the lock collar and the piston, wherein a following biasing element causes the following collar to follow the piston when the piston translates to prevent the lock collar from rotating about the center axis from the unlock position to the lock position;

wherein the following collar comprises a third number of features configured to extend from the following collar away from the center axis and configured to prevent the lock collar from rotating about the center axis from the unlock position to the lock position when the first number of features of the piston is located at a first side of the lock collar; and wherein the movable member further comprises a radial slot into which a single rotatable feature projects, such that translation of the movable member along a transverse axis is configured to force the single rotatable feature against one of two sides of the radial slot, which in turn is configured to force the lock collar to rotate about the center axis.

* * * * *